US009265327B2

(12) United States Patent
Thulin et al.

(10) Patent No.: US 9,265,327 B2
(45) Date of Patent: Feb. 23, 2016

(54) CONTAINERS FOR DISPENSING PERSONAL CARE PRODUCT

(71) Applicant: The Procter & Gamble Company, Cincinnati, OH (US)

(72) Inventors: Nathaniel David Thulin, Hebron, KY (US); Christopher Eugene Bates, Cincinnati, OH (US); David Andrew Dalton, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 441 days.

(21) Appl. No.: 13/733,698

(22) Filed: Jan. 3, 2013

(65) Prior Publication Data

US 2013/0170886 A1 Jul. 4, 2013

Related U.S. Application Data

(60) Provisional application No. 61/583,012, filed on Jan. 4, 2012.

(51) Int. Cl.

| | |
|---|---|
| ***A45D 40/06*** | (2006.01) |
| ***A45D 40/04*** | (2006.01) |
| *A45D 40/00* | (2006.01) |

(52) U.S. Cl.

CPC ..... *A45D 40/06* (2013.01); *A45D 40/04* (2013.01); *A45D 2040/0062* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,887,692 | A | 6/1975 | Gilman | |
| 3,904,741 | A | 9/1975 | Jones et al. | |
| 4,120,948 | A | 10/1978 | Shelton | |
| 4,298,036 | A * | 11/1981 | Horvath | 141/1 |
| 4,331,609 | A | 5/1982 | Orr | |
| 4,359,456 | A | 11/1982 | Gosling et al. | |
| 4,605,330 | A | 8/1986 | Crowley et al. | |
| 4,702,399 | A | 10/1987 | Davis | |
| 4,915,528 | A * | 4/1990 | Seager | 401/68 |
| 5,326,185 | A | 7/1994 | Dornbusch et al. | |
| 5,401,112 | A | 3/1995 | Dornbusch et al. | |
| 5,516,511 | A | 5/1996 | Motley et al. | |
| 5,587,153 | A | 12/1996 | Angelone, Jr. et al. | |
| 5,718,890 | A | 2/1998 | Putnam et al. | |
| 5,871,717 | A | 2/1999 | Bretzler et al. | |
| 6,123,932 | A | 9/2000 | Guskey et al. | |
| 6,752,982 | B2 | 6/2004 | Colwell et al. | |

(Continued)

FOREIGN PATENT DOCUMENTS

| | | | |
|---|---|---|---|
| BE | 825146 | 8/1975 | |
| EP | 0196385 A2 * | 8/1986 | A45D 40/04 |
| GB | 1347950 | 2/1974 | |

OTHER PUBLICATIONS

PCT International Search Report and Written Opinion dated Mar. 12, 2013.

*Primary Examiner* — David Walczak
(74) *Attorney, Agent, or Firm* — Carl J. Roof; James C. Vago

(57) ABSTRACT

A container is configured for selectively dispensing a personal care product. The container includes a body, a drive apparatus, and an elevator. The body at least partially defines a product chamber and a distal opening. The elevator is disposed within the product chamber. Rotation of the drive apparatus results in axial movement of the elevator within the product chamber.

16 Claims, 18 Drawing Sheets

(56) References Cited

U.S. PATENT DOCUMENTS

| | | | |
|---|---|---|---|
| 8,147,808 | B2 | 4/2012 | Scavone et al. |
| 2006/0163313 | A1 | 7/2006 | Larson |
| 2006/0263311 | A1 | 11/2006 | Scavone et al. |
| 2006/0263312 | A1 | 11/2006 | Scavone et al. |
| 2006/0292098 | A1 | 12/2006 | Scavone et al. |
| 2007/0248553 | A1 | 10/2007 | Scavone et al. |
| 2007/0264214 | A1 | 11/2007 | Scavone et al. |
| 2007/0264215 | A1 | 11/2007 | Scavone et al. |
| 2008/0008671 | A1 | 1/2008 | Scavone et al. |
| 2008/0085250 | A1 | 4/2008 | Scavone et al. |
| 2008/0213191 | A1 | 9/2008 | Scavone et al. |
| 2008/0213203 | A1 | 9/2008 | Seavone et al. |
| 2008/0213204 | A1 | 9/2008 | Scavone et al. |
| 2008/0215023 | A1 | 9/2008 | Scavone et al. |
| 2009/0324660 | A1 | 12/2009 | Cetti et al. |
| 2012/0039654 | A1 | 2/2012 | Baines et al. |
| 2012/0039655 | A1 | 2/2012 | Baines et al. |

* cited by examiner

CONTAINERS FOR DISPENSING PERSONAL CARE PRODUCT

FIELD OF THE INVENTION

A container is provided for dispensing a personal care product, and related methods.

BACKGROUND OF THE INVENTION

Conventional deodorant and antiperspirant containers use an elevator/screw system to dispense product, in what is commonly referred to as a "swivel-up" configuration. Such a container is typically equipped with an elevator, disposed within a body of the container, and having a screw in threaded engagement with the elevator. A knob is accessible on the bottom of the exterior of the container, for use by a consumer to rotate the screw. During use, the knob is turned by the consumer to rotate the screw and move the elevator towards the top of the container, thus pushing up the product.

One method of manufacturing and filling swivel-up type containers is known as an open bottom fill process. In accordance with this method, an annular side wall having an oval or circular cross-section is provided, and a removable cap, of the same cross-section, is provided on the top of the side wall. The cap has a smooth concave inner surface which is adapted to function as a mold in forming the top of the product or, alternatively, a foil or other factory seal is provided for that purpose. The product, in its molten or liquid state, is poured into the product chamber from the bottom of the side wall. While the product is still in a molten or liquid form within the product chamber, a base, to which an elevator/screw system has previously been movably coupled, is attached to the bottom of the side wall through use of adhesives, welding or otherwise. The product and container are then allowed to cool, whereby the product takes on a desired shape. The present inventors have recognized, however, that attachment of the base to the bottom of the side wall in this manner results in excessive piece parts, manufacturing complexity and cost, and presents a visible seam or witness line where the base is welded or adhered to the bottom of the side wall, that is aesthetically displeasing to consumers.

Another method of manufacturing and filling swivel-up type containers is known as a closed bottom fill process. In accordance with this method, an annular side wall having an oval or circular cross-section is provided. A base is formed as a unitary structure with a bottom end of the side wall and defines an opening. An elevator is inserted through a top opening defined by the side wall, and a screw is inserted through the opening in the base and into threaded engagement with the elevator. A removable cap is provided on the top of the side wall. The cap has a smooth concave inner surface which is adapted to function as a mold in forming the top of the product or, alternatively, a foil or other factory seal is provided for that purpose. The product, in its molten or liquid state, is poured into the product chamber through one or more opening(s) in a knob of an elevator/screw system, with a plug then optionally being inserted into the knob to block the opening(s). The product and container are then allowed to cool, whereby the product takes on a desired shape. The present inventors have recognized, however, that pouring of product through one or more openings in a knob of an elevator/screw system can result in filling inefficiencies and disadvantages, such as excessive turbulence and splashing of product within the product chamber. Additionally, the present inventors have recognized that, unlike the open bottom fill process described above and the top fill process described below, this closed bottom fill process requires the knob of an elevator/screw system to provide a flow area that is sufficient to accommodate the pouring of product into the product chamber, i.e., an open configuration, thus preventing use of certain knob configurations that might otherwise provide ergonomic, aesthetic, efficiency, and/or other advantages. Furthermore, the present inventors have recognized that this closed bottom fill process is not effective for use with less viscous products (e.g., soft solid type products as described below), due to a tendency of the less viscous products to leak from the container, through the opening(s) in the knob, during use of the container by a consumer to dispense product onto the skin. Accordingly, the present inventors have recognized that less viscous products would conventionally require either the open bottom fill process described above or the top fill process described below.

Another method of manufacturing and filling swivel-up type containers is known as the fill/invert or top fill process. This method involves a container having an oval or circular cross-section, but with a closed bottom already having an elevator/screw system attached. The product is poured into the container from the top, and the top of the container is then sealed by a cap having a smooth concave inner surface for molding the end of the product. The container is then inverted so that some of the molten or liquid product flows from the bottom of the container to the top of the container, to fill the volume intermediate the original fill line and the cap. The container is kept in this position during cooling. An advantage of the top fill process over the open bottom fill process, is that the container of the top fill process does not have a seam that presents a witness line, as discussed above. Another advantage of the top fill process over the open bottom fill process, is that the container of the top fill process can better seal the product within the container to prevent evaporation of the product during storage of the container.

The inventors have recognized a need for greater flexibility in the design and manufacture of a "swivel-up" container. For example, the inventors have recognized a need for a simple, inexpensive, and easy-to-manufacture container, that does not provide any witness line, that provides flexibility in design of the knob, that can be filled using any of a plurality of fill processes and with a variety of different products, and that can facilitate multiple sealing and elevator configurations. For example, the inventors have recognized a need for a container that can be filled either using a closed bottom fill process or an open bottom fill process. As another example, the inventors have recognized a need for a container that can be filled using either a bottom fill process (closed and/or open) or a top fill process.

SUMMARY OF THE INVENTION

In accordance with one embodiment, a container is configured for selectively dispensing a personal care product. The container comprises a body, a drive apparatus, and an elevator. The body comprises a side wall and a base. The side wall comprises an inner surface that at least partially defines a product chamber. The inner surface extends axially from the base to a proximal opening. The base defines a distal opening. The drive apparatus comprises a knob and an elongated stem. The elongated stem is attached to the knob and defines a thread. The elevator is disposed within the product chamber and comprises an inner member and an outer member. The inner member defines a threaded aperture. The outer member defines a bore and comprises an exterior rim structure in engagement with the inner surface of the side wall of the body. The inner member is dimensioned to pass through the distal opening in the base and into mating engagement at least partially within the bore of the outer member. Rotation of the drive apparatus results in axial movement of the elevator within the product chamber.

In accordance with another embodiment, wherein a container is configured for selectively dispensing a personal care product. The container comprises means for defining a product chamber, a proximal opening, and a distal opening. The container further comprises means for selectively elevating a product within the product chamber and through the proximal opening, said means comprising an elevator and a drive means. The elevator is disposed within the product chamber and comprises an inner member and an outer member. The inner member defines a threaded aperture engaged with the drive means and is dimensioned to pass through the distal opening into mating engagement with the outer member.

In accordance with yet another embodiment, a method is provided for filling a container with a personal care product. The container comprises a body having a side wall and a base. The side wall comprises an inner surface that at least partially defines a product chamber, and extends axially from the base to a proximal opening. The base defines a distal opening. The method comprises providing the body with the distal opening facing upwardly, an outer member of an elevator retained at a fill position within the product chamber, and the proximal opening being capped. A filling head is inserted through the distal opening and into the product chamber. Product is released from the filling head into the product chamber, and the filling head is withdrawn from the product chamber. A drive apparatus is provided that comprises a knob and an elongated stem. The elongated stem is attached to the knob and defines a thread. An inner member of the elevator is threadably engaged with the elongated stem. A portion of the drive apparatus is inserted through the distal opening such that the inner member passes through the distal opening and matingly engages at least partially within a bore in the outer member.

In accordance with yet another embodiment, a method of filling containers is provided. Each of the containers comprises a body, an elevator, and a drive apparatus. The body has a side wall and a base. The base is formed as a unitary structure with the side wall. The side wall comprises an inner surface that at least partially defines a product chamber. The inner surface extends axially from the base to a proximal opening. The base defines a distal opening. The elevator comprises an inner member and an outer member. The drive apparatus comprises a knob and an elongated stem. The elongated stem is attached to the knob and defines a thread. The elongated stem is threadably engaged with the inner member of the elevator. The outer member of the elevator is retained at a fill position within the product chamber. The proximal opening is capped. With respect to a first one of the containers, the method comprises an open bottom fill method, in which the body is provided with the distal opening facing upwardly, a filling head is inserted through the distal opening and into the product chamber, product is released from the filling head into the product chamber, the filling head is withdrawn from the product chamber, and a portion of the drive apparatus is inserted through the distal opening such that the inner member passes through the distal opening and matingly engages at least partially within a bore in the outer member. With respect to a second one of the containers, the method comprises a closed bottom fill method, in which the body is provided with the distal opening facing upwardly, and with a portion of the drive apparatus inserted through the distal opening such that the inner member is matingly engaged at least partially within a bore in the outer member, and product is released from a filling head, through a knob aperture in the knob, and into the product chamber.

In accordance with yet another embodiment, a method of open bottom filling a container is provided. The container comprises a body, an elevator, and a drive apparatus. The body has a side wall and a base. The base is formed as a unitary structure with the side wall. The side wall comprises an inner surface that at least partially defines a product chamber. The inner surface extends axially from the base to a proximal opening. The base defines a distal opening. The elevator comprises an inner member and an outer member. The drive apparatus comprises a knob and an elongated stem. The elongated stem is attached to the knob and defines a thread. The elongated stem is threadably engaged with the inner member of the elevator. The outer member of the elevator is retained at a fill position within the product chamber. The proximal opening is capped. The method comprises providing the body with the distal opening facing upwardly, and releasing a soft solid type product from a filling head into the product chamber. The method further comprises inserting a portion of the drive apparatus through the distal opening such that the inner member passes through the distal opening and matingly engages at least partially within a bore in the outer member.

In accordance with yet another embodiment, a method of filling containers is provided. Each of the containers comprises a body, an elevator, and a drive apparatus. The body has a side wall and a base. The base is formed as a unitary structure with the side wall. The side wall comprises an inner surface that at least partially defines a product chamber. The inner surface extends axially from the base to a proximal opening. The base defines a distal opening. The elevator comprises an inner member and an outer member. The drive apparatus comprises a knob and an elongated stem. The elongated stem is attached to the knob and defines a thread. The elongated stem is threadably engaged with the inner member of the elevator. The outer member of the elevator is retained at a fill position within the product chamber. The proximal opening is capped. With respect to a first one of the containers, the method comprises an open bottom fill method in which the body is provided with the distal opening facing upwardly, a soft solid type product is released from a filling head into the product chamber, and a portion of the drive apparatus is inserted through the distal opening such that the inner member passes through the distal opening and matingly engages at least partially within a bore in the outer member. With respect to a second one of the containers, the method comprises a bottom fill method in which the body is provided with the distal opening facing upwardly, and an invisible solid type product is released from a filling head into the product chamber.

In accordance with another embodiment, a container is configured for selectively dispensing a personal care product. The container comprises a body, a drive apparatus, and an elevator. The body comprises an inner surface. The inner surface at least partially defines a product chamber and defines a proximal opening. The drive apparatus comprises a knob and an elongated stem. The elongated stem is attached to the knob and defines a thread. The elevator is disposed within the product chamber and comprises an inner member and an outer member. The inner member defines a threaded aperture. The outer member defines a bore and comprises an exterior rim structure in engagement with the inner surface of the body. The inner member is engaged in a snap-fit at least partially within the bore of the outer member. Rotation of the drive apparatus results in axial movement of the elevator within the product chamber.

In accordance with yet another embodiment, a container is configured for selectively dispensing a personal care product. The container comprises means for defining a product chamber and a proximal opening. The container further comprises means for selectively elevating a product within the product chamber and through the proximal opening, including an elevator and a drive means. The elevator is disposed within the product chamber and comprises an inner member and an outer member. The inner member defines a threaded aperture engaged with the drive means and engaged in a snap-fit at least partially within the bore of the outer member.

In accordance with still another embodiment, a container is configured for selectively dispensing a personal care product. The container comprises a body, a drive apparatus, and an elevator. The body comprises a side wall and a base. The side wall comprises an inner surface that at least partially defines a product chamber. The inner surface extends axially from the base to a proximal opening. The base defines a distal opening. The drive apparatus comprises a knob and an elongated stem. The elongated stem is attached to the knob and defines a thread. The elevator is disposed within the product chamber and defines a hole. The hole is configured to receive a filling head and has a cross-sectional area greater than 3 $cm^2$. Rotation of the drive apparatus results in axial movement of the elevator within the product chamber.

BRIEF DESCRIPTION OF THE DRAWINGS

While the specification concludes with claims, it is believed that the same will be better understood from the following description taken in conjunction with the accompanying drawings in which:

DETAILED DESCRIPTION OF THE INVENTION

Figure 1:
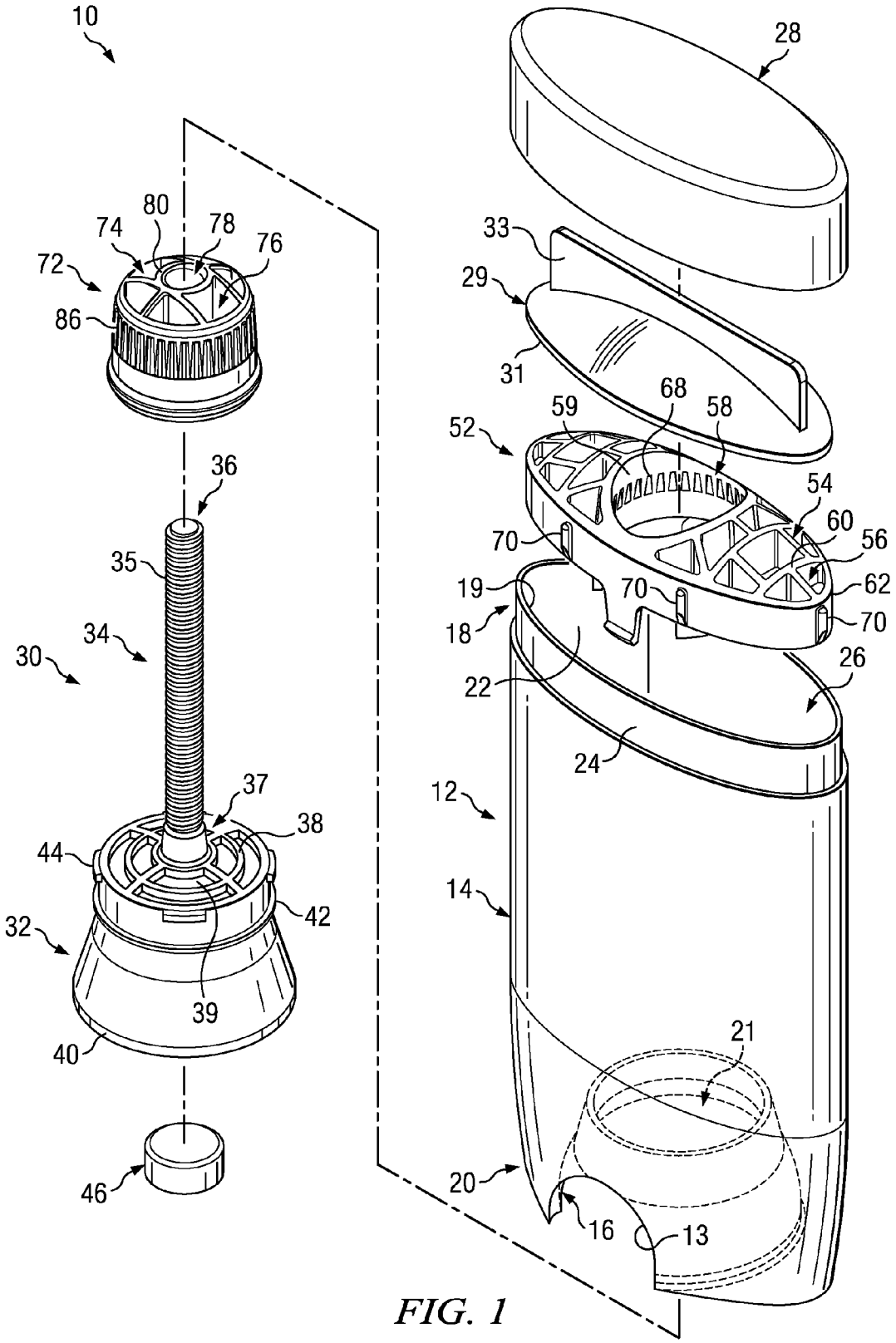
FIG. 1 is an exploded perspective view depicting an unfilled container in accordance with one embodiment.

Certain embodiments are hereinafter described in detail in connection with the views and examples of FIGS. 1, 2A-2C, 3A-3C, 4A-4E, 5-7, 8A-8B, and 9A-9E, wherein like numbers illustrate like elements throughout the views.

A container is configured for selectively dispensing a personal care product such as, for example, an antiperspirant and/or deodorant composition for application to the underarm or other portion of a human body. It will be appreciated, however, that the container can alternatively be configured to dispense any of a variety of other suitable types of personal care products or other types of products. With reference to FIGS. 1, 2A-2C, 3A-3C, 4A-4E, 5, 6 and 7, a container 10 can include a body 12, a drive apparatus 30, and an elevator 50 (FIGS. 4E and 6), as well as a product to be selectively dispensed, as described in further detail below.

A personal care product can include one or more antiperspirant actives and/or perfumes, for example, and possibly one or more additional or alternative ingredients, and can be in any of a variety of forms including what is commonly termed a soft solid type product or an invisible solid type product. A soft solid type product, like a lotion or clear gel type product, can be dispensed as a thick, viscous liquid (e.g., like a thick lotion) for application to the skin. In contrast, an invisible solid type product can generally be in the form of a solid stick (e.g., white in color, or semi-transparent) that is wiped on the skin to leave behind a thin coating of product, with the thin coating often being invisible or semi-invisible. In one embodiment, the personal care product can include one or more volatile fluids, wherein the total concentration of the one or more volatile fluids is from about 20% to less than about 80% by weight of the composition. Other common constituents that can be included therein can be found in U.S. Pat. No. 6,752,982, issued to Colwell et al. on Jun. 22, 2004, and in U.S. Patent Application Publication No. 2007/0248552 to Scavone et al. and published on Oct. 25, 2007, and can for example include water, hydrocarbons, volatile and non-volatile silicones, and polyhydric alcohols. Examples of formulations for suitable soft solid type products can be found in U.S. Pat. No. 5,718,890, issued to Putnam et al. on Feb. 17, 1998, and U.S. Pat. No. 5,871,717, issued to Bretzler et al. on Feb. 16, 1999. Examples of formulations for suitable invisible solid type products can be found in U.S. Pat. No. 5,516,511, issued to Motley et al. on May. 14, 1996.

Examples of formulations for suitable clear gel type products can be found in U.S. Pat. No. 5,587,153, issued to Angelone, Jr. et al. on Dec. 24, 1996.

The antiperspirant actives can include any compound, composition, or other material having antiperspirant activity. The antiperspirant actives can include astringent metallic salts. In particular, the antiperspirant actives can include inorganic and organic salts of aluminum, zirconium and zinc, as well as mixtures thereof. Antiperspirant active examples can include, but are not limited to, aluminum-containing and/or zirconium-containing salts or materials, such as aluminum halides, aluminum chlorohydrate, aluminum hydroxyhalides, zirconyl oxyhalides, zirconyl hydroxyhalides, and mixtures thereof.

In one embodiment, aluminum salts can include those that conform to a formula:

$$Al_2(OH)_aCl_b.xH_2O$$

wherein a is from about 0 to about 5; a sum of a and b is about 6; x is from about 1 to about 8; where a, b, and x can have non-integer values. For example, aluminum chlorohydroxides referred to as "¾ basic chlorohydroxide," wherein a is about 4.5; "⅚ basic chlorohydroxide", wherein a=5; and "⅔ basic chlorohydroxide", wherein a=4 can be used. Processes for preparing aluminum salts are disclosed in U.S. Pat. No. 3,887,692, issued to Gilman on Jun. 3, 1975; U.S. Pat. No. 3,904,741, issued to Jones et al. on Sep. 9, 1975; and U.S. Pat. No. 4,359,456 issued to Gosling et al. on Nov. 16, 1982. A general description of such aluminum salts can also be found in Antiperspirants and Deodorants, Cosmetic Science and Technology Series Vol. 20, 2nd edition, edited by Karl Laden. Mixtures of aluminum salts are described in British Patent Specification 1,347,950, filed in the name of Shin et al. and published Feb. 27, 1974.

In one embodiment, zirconium salts can include those which conform to a formula:

$$ZrO(OH)_{2-a}Cl_a.xH_2O$$

wherein a is from about 0.5 to about 2; x is from about 1 to about 7; where a and x can both have non-integer values. Such zirconium salts are described in Belgian Patent 825,146, issued to Schmitz on Aug. 4, 1975. In one embodiment, antiperspirant soft solid compositions can include zirconium salt complexes that additionally contain aluminum and glycine, commonly known as "ZAG complexes." Such complexes can contain aluminum chlorohydroxide and zirconyl hydroxy chloride conforming to formulas as set forth above. Such ZAG complexes are described in U.S. Pat. No. 4,331,609, issued to Orr on May 25, 1982 and U.S. Pat. No. 4,120,948, issued to Shelton on Oct. 17, 1978.

A perfume or deodorant active can be selected from the group consisting of antimicrobial agents (e.g., bacteriocides, fungicides), malodor-absorbing material, and combinations thereof. For example, antimicrobial agents can comprise cetyl-trimethylammonium bromide, cetyl pyridinium chloride, benzethonium chloride, diisobutyl phenoxy ethoxy ethyl dimethyl benzyl ammonium chloride, sodium N-lauryl sarcosine, sodium N-palmethyl sarcosine, lauroyl sarcosine, N-myristoyl glycine, potassium N-lauryl sarcosine, trimethyl ammonium chloride, sodium aluminum chlorohydroxy lactate, triethyl citrate, tricetylmethyl ammonium chloride, 2,4,4'-trichloro-2'-hydroxy diphenyl ether (triclosan), 3,4,4'-trichlorocarbanilide (triclocarban), diaminoalkyl amides such as L-lysine hexadecyl amide, heavy metal salts of citrate, salicylate, and piroctose, for example, zinc salts, and acids thereof, heavy metal salts of pyrithione, especially zinc pyrithione, zinc phenolsulfate, farnesol, and combinations thereof. Concentrations levels of antiperspirant and deodorant actives can be selected depending upon whether the product is a soft solid type product or an invisible solid type product, and/or depending upon other desired characteristics of the product.

Figure 4A:
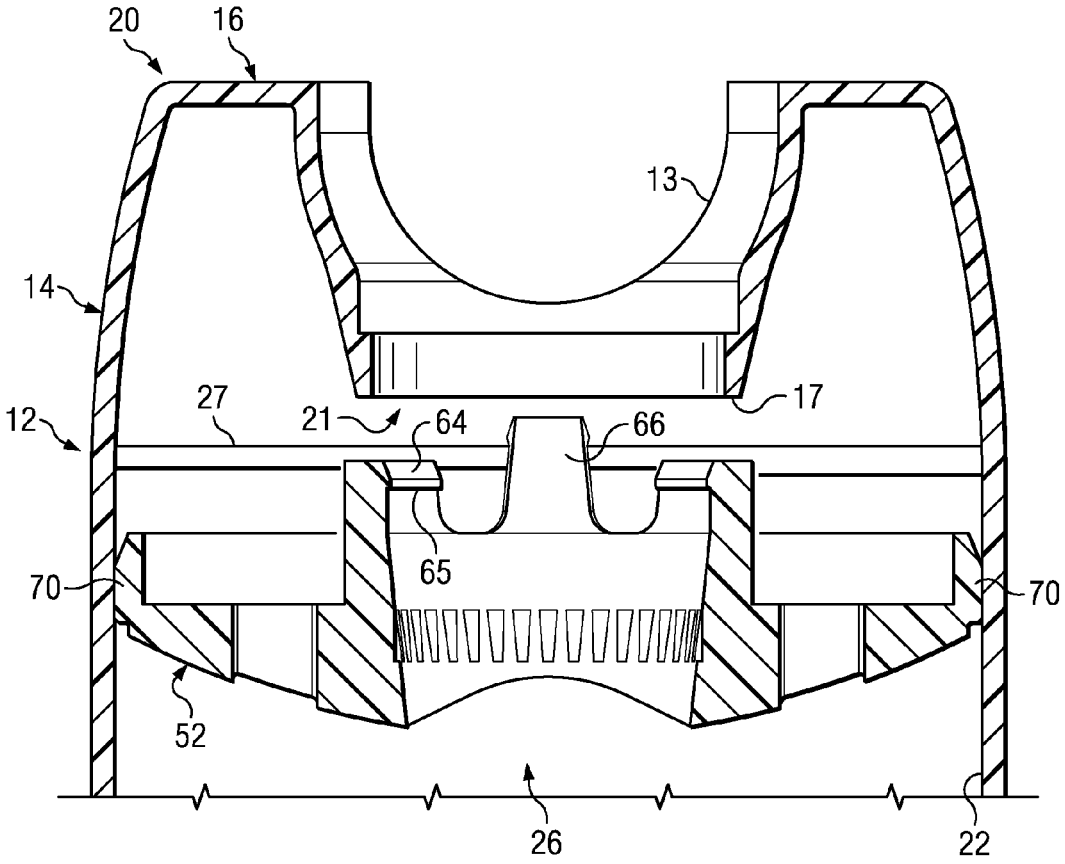
FIG. 4A is a front cross-sectional view depicting an outer member of the elevator disposed within a product chamber defined by a body of the container of FIG. 1, wherein the outer member is in a fill position.

With particular reference to FIGS. 1 and 4A, the body 12 is shown to include a side wall 14 and a base 16, and to extend axially between a proximal end 18 and a distal end 20. The base 16 is shown in FIG. 4A to be formed as a unitary structure with the side wall 14, but alternatively can be formed separately from the side wall but attached to the side wall such as with adhesive, mechanically interlocking features, and/or welding. The side wall 14 can comprise an inner surface 22 that at least partially defines a product chamber 26, and that can be generally tubular and extend axially from the base 16 to a proximal opening 19. The proximal opening 19 is shown to be disposed adjacent to the proximal end 18 of the body 12, and to be defined by the inner surface 22 of the side wall 14. The base 16 can define a distal opening 21. The distal opening 21 can have an area of from about 1 $cm^2$ to about 3 $cm^2$, and can be opposite the proximal opening 19, relative to the product chamber 26. The distal opening 21 can be smaller than the proximal opening 19, as shown in FIG. 1, for example. While the distal opening 21 is shown in FIGS. 1 and 4A to be generally centrally located in the base 16, it will be appreciated that, in other embodiments, the distal opening might not be centrally located. The inner surface 22 can define an oval cross-sectional shape for the product chamber 26, as shown in the embodiment of FIG. 1. Alternatively, the inner surface can define a different cross-sectional shape for the product chamber such as, for example, a circle, rectangle or any other suitable shape.

The elevator 50 can be disposed in the product chamber 26, such that, during use of the container 10 by a consumer, the elevator 50 can be selectively raised (i.e., moved closer to the proximal opening 19) to result in product being dispensed from the product chamber 26 and through the proximal opening 19. In one embodiment, when the product is an invisible solid type product, upon lowering of the elevator 50 (i.e., moved away from the proximal opening 19), the invisible solid type product can be retracted into the product chamber 26 through the proximal opening 19.

In one embodiment, the elevator 50 can have a size and shape to generally correspond with the cross-sectional shape defined by the inner surface 22 of the side wall 14, and to conform substantially to or with the inner surface 22 of the side wall 14. In one embodiment, multiple separate components can be attached together to form the elevator 50. For example, with reference to FIGS. 1, 2A-2C, 3A-3C, 4E, and 6, the elevator 50 can comprise an outer member 52 and an inner member 72.

The outer member 52 can comprise an exterior rim structure 62 that engages the inner surface 22 of the side wall 14 of the body 12. The exterior rim structure 62 can include one or more skis 70. It will be appreciated that the skis 70 can serve to space other portions of the exterior rim structure 62 from the inner surface 22, to reduce the amount of surface area of the outer member 52 that contacts the inner surface 22, and to reduce the amount of friction and force that would otherwise be needed to move the elevator 50 axially (e.g., up and down) within the product chamber 26.

In one embodiment, the elevator 50 can have a dome-shaped upper surface, to facilitate comfortable application to the skin of the product in the container 10 by a consumer, and to minimize product waste. The upper surface of the elevator 50 can comprise surface discontinuity to facilitate adherence to the elevator 50 by the product disposed in the product chamber 26. For example, the outer member 52 can comprise a skeletal structure 54 which extends between a bore 58 and the exterior rim structure 62. The skeletal structure 54 can comprise an upper surface 60 and can define one or more apertures (e.g., 56) extending axially through the outer member 52, and thus passing through the elevator 50. Likewise, the inner member 72 can comprise a skeletal structure 74 that comprises an upper surface 80 and that defines one or more apertures (e.g., 76) extending axially through the inner member 72, and thus passing axially through the elevator 50. Together, the skeletal structures 54 and 74 can provide sufficient surface discontinuity to facilitate adherence of the product to the elevator 50 during normal use of the container 10 by a consumer. It will be appreciated, however, that a skeletal structure of an inner and/or outer member of an elevator might not include any axially-extending aperture(s), that one or both of an inner and/or outer member of an elevator might include some different type of surface discontinuity (e.g., embossed surface texture), and/or that one or both of an inner and/or outer member of an elevator might not include any surface discontinuity. As an example of another type of surface discontinuity, an upper surface of an outer and/or inner member of an elevator can be provided with a plurality of depressions or sockets (not shown) to provide enhanced anchoring of a solidified product to the elevator. A vent hole can be provided in the bottom surface of each socket to permit the escape of trapped air, and thereby allow molten product to enter the sockets for increased product adherence to the elevator. Number, size and location of the sockets may be varied as appropriate in order to provide adequate product support and adherence, while minimizing product waste.

Figure 2A:
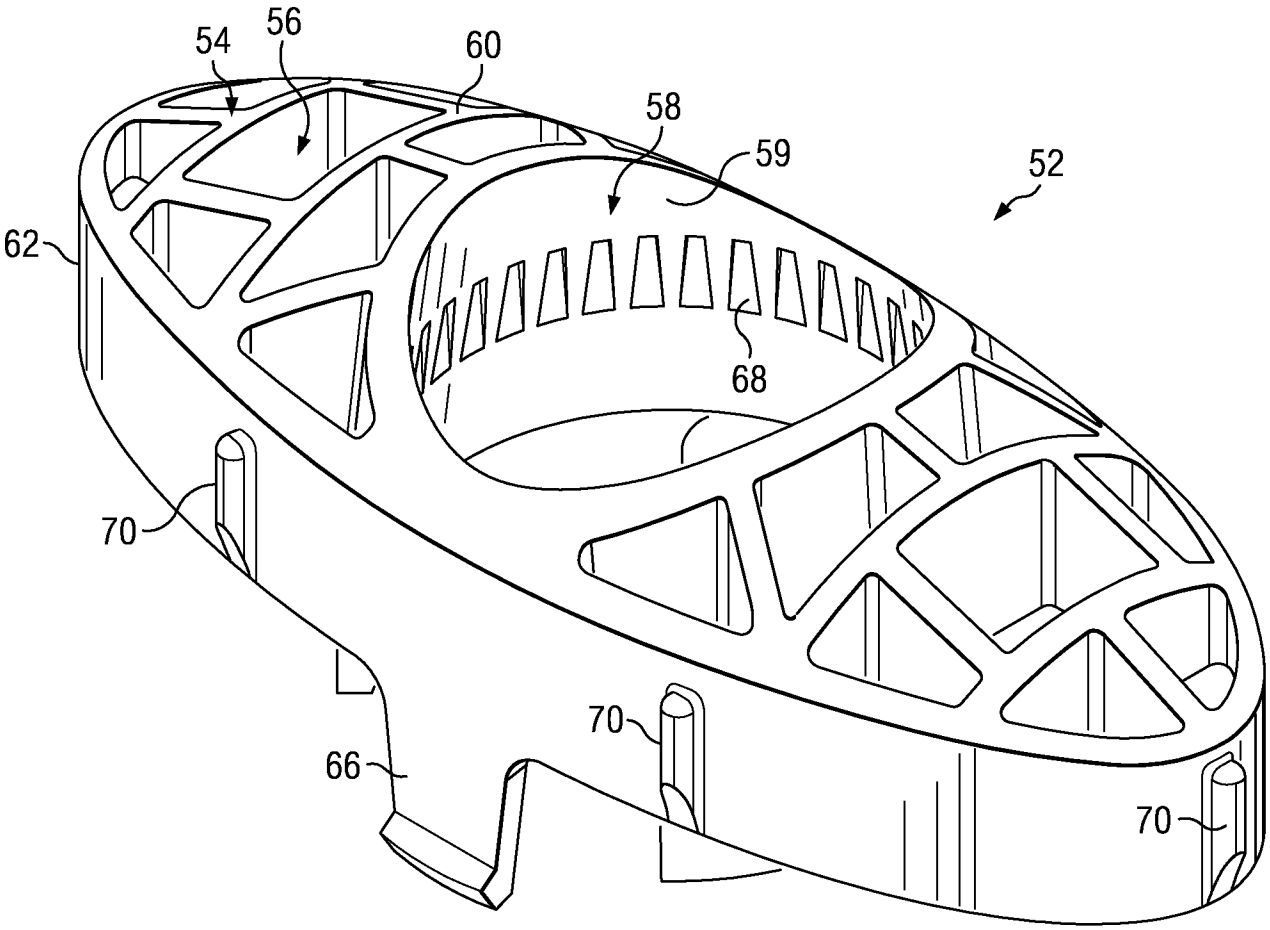
FIG. 2A is a perspective view depicting an outer member of an elevator of the container of FIG. 1.
Figure 2B:
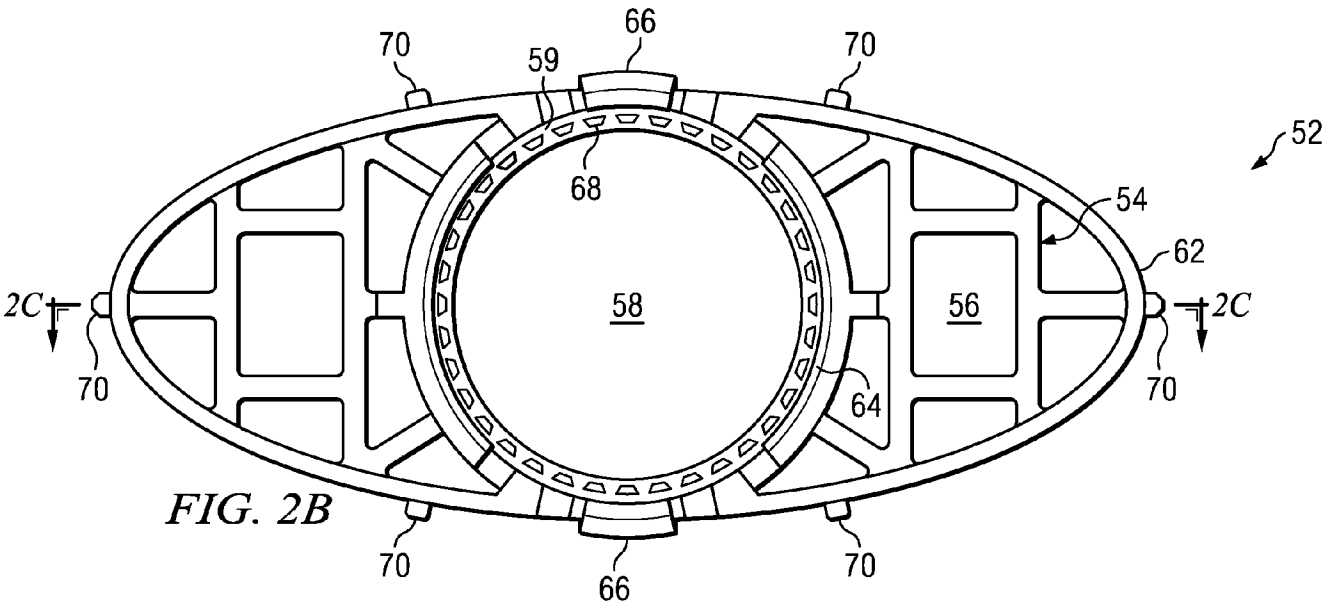
FIG. 2B is a bottom plan view depicting the outer member of the elevator of FIG. 2B.
Figure 2C:
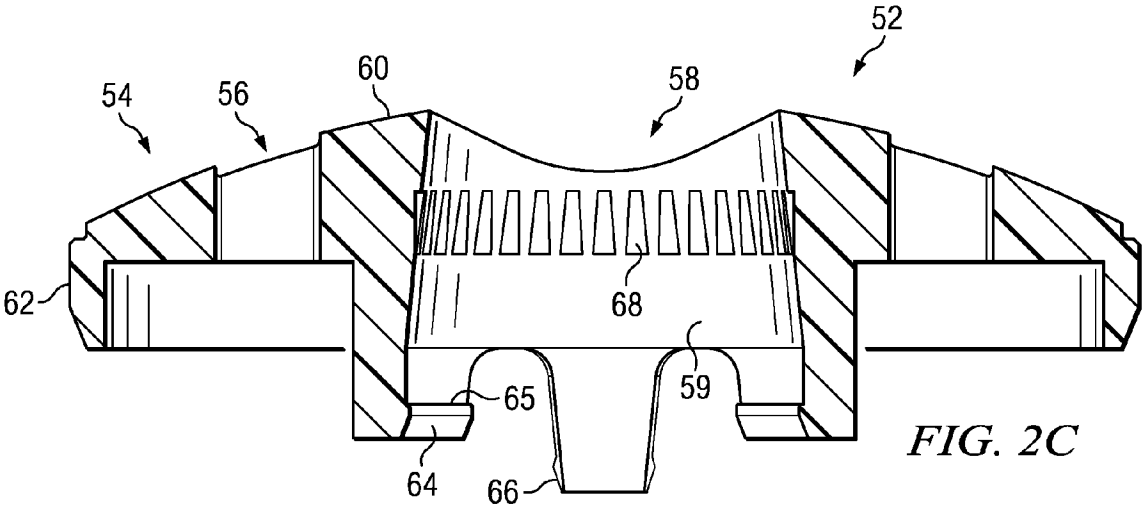
FIG. 2C is a cross-sectional view depicting the outer member of the elevator of FIG. 2B, taken along the section lines 2C-2C in FIG. 2B.

With reference to FIGS. 2A-2C, the outer member 52 can define a bore 58 for selectively receiving at least a portion of the inner member 72, in mating engagement. When the inner member 72 is matingly engaged with the outer member 52, the inner member 72 can be both axially and radially retained relative to the outer member 52. To facilitate radial retention of the inner member 72 relative to the outer member 42, the inner member 72 and the outer member 52 can comprise corresponding anti-rotation structures provided in any of a variety of suitable configurations. For example, the corresponding anti-rotation structures can comprise corresponding protrusions and grooves provided by respective inner and outer members of an elevator, as described below with reference to the embodiment of FIG. 1. As another example, the corresponding anti-rotation structures can comprise the inner member and the bore of the outer member having complementary non-circular shapes when viewed in a top plan view, such as discussed below with reference to FIG. 9C. It will be appreciated that corresponding anti-rotation structures can be helpful to prevent rotation of the inner member 72 relative to the outer member 52 during rotation of the knob 32 in use of the container 10 by a consumer, as might otherwise result due to lubricity of a product within the product chamber 26. Silicones and/or other constituents, such as may be in soft solid type products, can provide such lubricity.

Figure 3A:
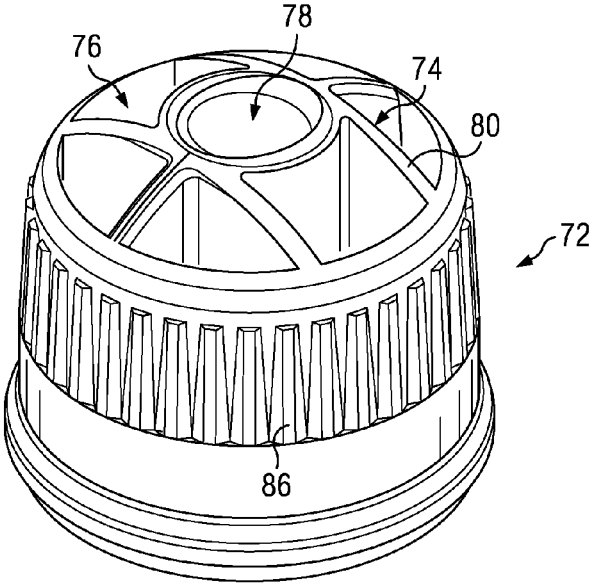
FIG. 3A is a perspective view depicting an inner member of the elevator of the container of FIG. 1.
Figure 3B:
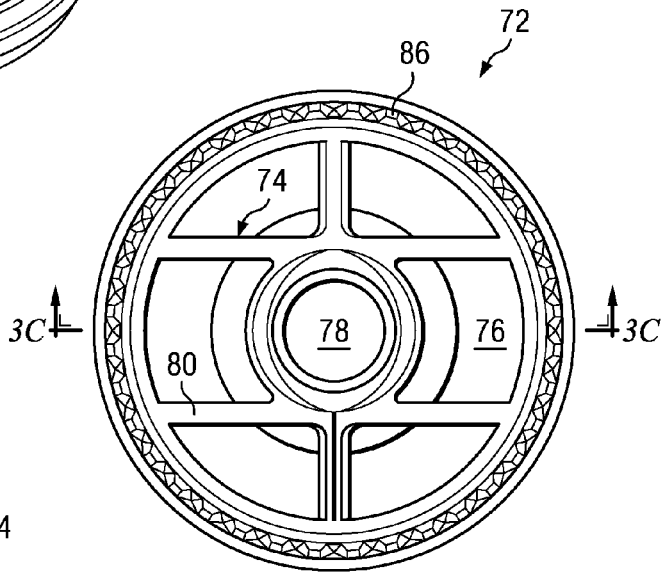
FIG. 3B is a top plan view depicting the inner member of the elevator of FIG. 3B.
Figure 3C:
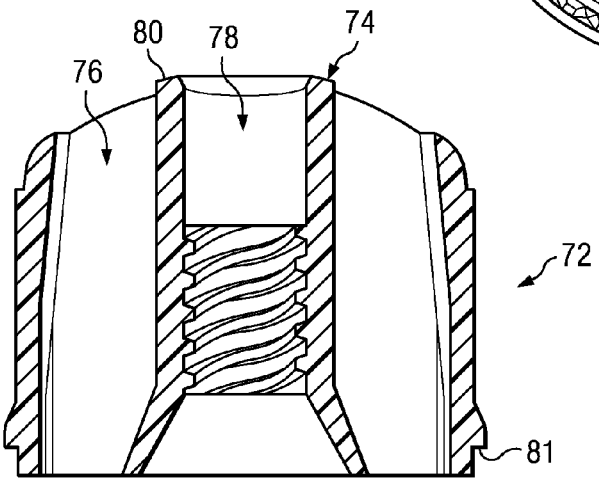
FIG. 3C is a cross-sectional view depicting the inner member of the elevator of FIG. 3B, taken along the section lines 3C-3C in FIG. 3B.

With particular reference to the embodiment of FIGS. 1 and 2A-2C, the outer member 52 can include a bore surface 59 that defines the bore 58, and that defines a plurality of grooves or protrusions. In the example shown, the bore surface 59 is shown to define a plurality of grooves 68 disposed circumferentially about the bore 58. The outer member 52 is also shown to define a ridge 64 that inwardly circumscribes at least a portion of the bore 58. The inner member 72 is shown in FIGS. 3A-3C to define a plurality of protrusions 86 disposed about its perimeter, and to define an engagement surface 81. To facilitate mating engagement of the outer member 52 and the inner member 72, the inner member 72 can be inserted at least partially into the bore 58 of the outer member 52, such that the respective protrusions 86 engage respective ones of the grooves 68, and such that the engagement surface 81 abuts a surface 65 defined by the ridge 64 of the outer member 52 (see FIGS. 2C, 3C and 4E). Respective ones of the protrusions 86 can engage respective ones of the grooves 68 at respective locations circumferentially disposed about the bore 58, to facilitate radial retention of the inner member 72 relative to the outer member 52, and thus to facilitate mating engagement of the inner member 72 with the outer member 52. It will be further appreciated that abutment of the engagement surface 81 with the surface 65 of the ridge 64 can prevent axial movement of the inner member 52 relative to the outer member 72, to further facilitate mating engagement of the inner member 72 with the outer member 52. In this manner, the ridge 64 can facilitate axial retention of the inner member 72 relative to the outer member 52. In an alternative embodiment, the outer member can define protrusions and the inner member can define corresponding grooves. The corresponding protrusions and grooves can be provided in any of a variety of suitable quantities, and to have any of a variety of suitable sizes, shapes, and configurations, to facilitate mating engagement of respective portions of an elevator.

It will be appreciated that an inner member can matingly engage an outer member of an elevator in a snap-fit configuration, as with elevators 50 and 550 described above, and 350 and 450 described below. It will be further appreciated that an inner member can engage an outer member in any of a variety of alternative snap-fit type configurations, in which rotational and/or axial movement of the inner member relative to the outer member are prevented upon engagement.

It will be further appreciated that an inner member and a corresponding bore of an outer member might not have generally round cross-sectional shapes as in FIG. 1, but might rather have a different cross-sectional shape, and/or can be provided in any of a variety of other suitable configurations. For example, with particular reference to the embodiment of FIG. 9C, it can be seen that an elevator 550 can be in some respects similar to the elevator 50, except for example that an inner member 572 and a corresponding bore 558 of an outer member 552 of the elevator 550, in top plan view, have complementary non-circular shapes, which in this embodiment are shown to be hexagons. In other embodiments, complementary non-circular shapes can be square, rectangle, triangle, or any of a variety of other suitable shapes. When the inner member and the outer member have complementary non-circular shapes (e.g., as in FIG. 9C) and are engaged with one another, the complementary non-circular shapes can provide an inherent anti-rotation function, to thus facilitate radial retention of the inner member 572 relative to the outer member 552, and rendering optional any grooves/protrusions or other additional type of corresponding anti-rotation structures.

Referring again to FIG. 1, the drive apparatus 30 can comprise a knob 32 and an elongated stem 34 attached to the knob 32. The knob 32 can include a grip surface 40 that is configured to be grasped by fingers of a consumer and can include, for example, knurling or other surface texture, or a particular shape, and/or be formed from a material that facilitates effective grasping. Access openings (e.g., 13) can be provided at the distal end 20 of the body 12 to facilitate access to the grip surface 40 of the knob 32 by a hand of a consumer. The drive apparatus 30 can further include a skeletal structure 38 that couples the knob 32 with the elongated stem 34. The knob 32, the elongated stem 34, and the skeletal structure 38 can be formed as a unitary structure. However, in other embodiments, such components can be formed separately from one another, and attached together through use of fasteners, adhesives, interlocking mechanical features, or otherwise. The elongated stem 34 can extend from a proximal end 36 to a distal end 37, and can define a thread 35 (e.g., a helical thread, as shown) extending along at least a substantial portion of its length. More particularly, the distal end 37 can be coupled with the skeletal structure 38. The proximal end or tip of the elongated stem can, in one embodiment (not shown), be formed of slightly larger diameter than the balance of the elongated stem, in order to act as a detent (e.g., to prevent removal of the inner member of the elevator once it has been snapped past the tip). In one embodiment, the skeletal structure 38 defines at least one knob aperture (e.g., 39) passing axially through the drive apparatus 30, though in an alternative embodiment, a skeletal structure of a drive apparatus might not define any aperture extending through the drive apparatus, and/or the drive apparatus might not include any skeletal structure. As discussed further below, the aperture(s) (e.g., 39) of the skeletal structure 38 can permit axial flow of molten product through the drive apparatus 30 during a closed bottom fill process. It will be appreciated that, in alternative embodiments, a drive apparatus might not include a knob and/or an elongated stem, and might for example instead include a lever, a track, a push-up mechanism, or some other suitable arrangement to facilitate selective advancement of product within the product chamber.

Figure 5:
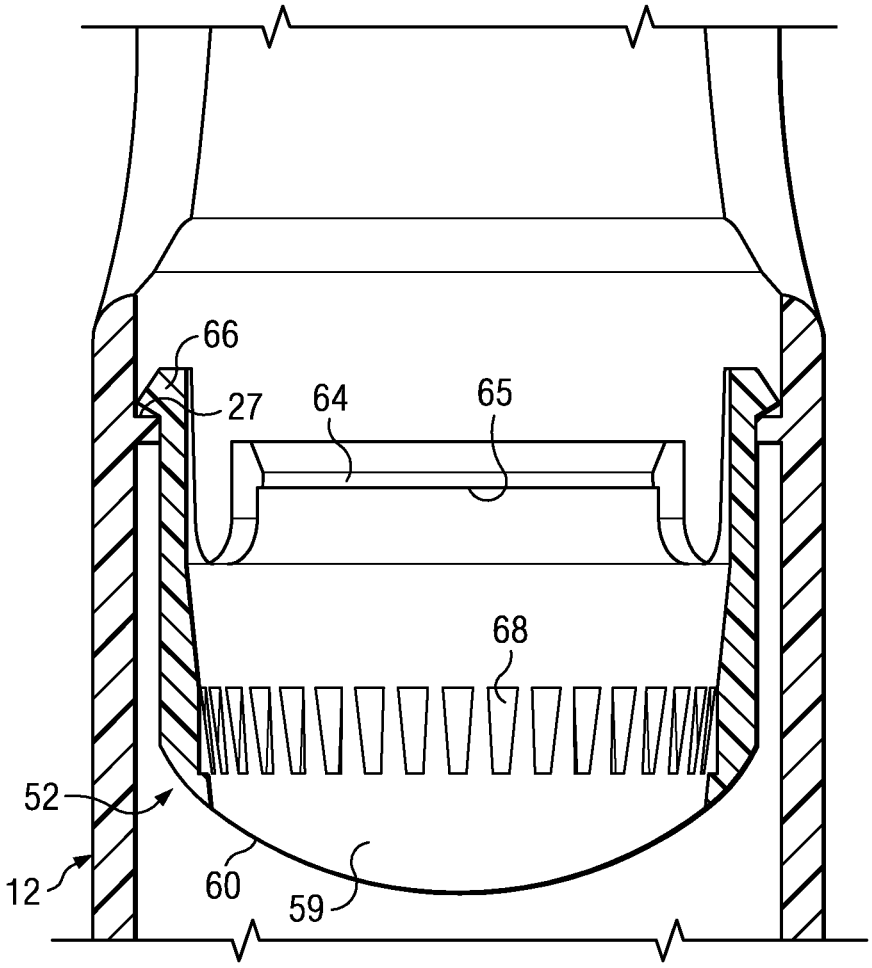
FIG. 5 is a side elevational view, partly in cross-section, illustrating a portion of the arrangement of FIG. 4A.
Figure 6:
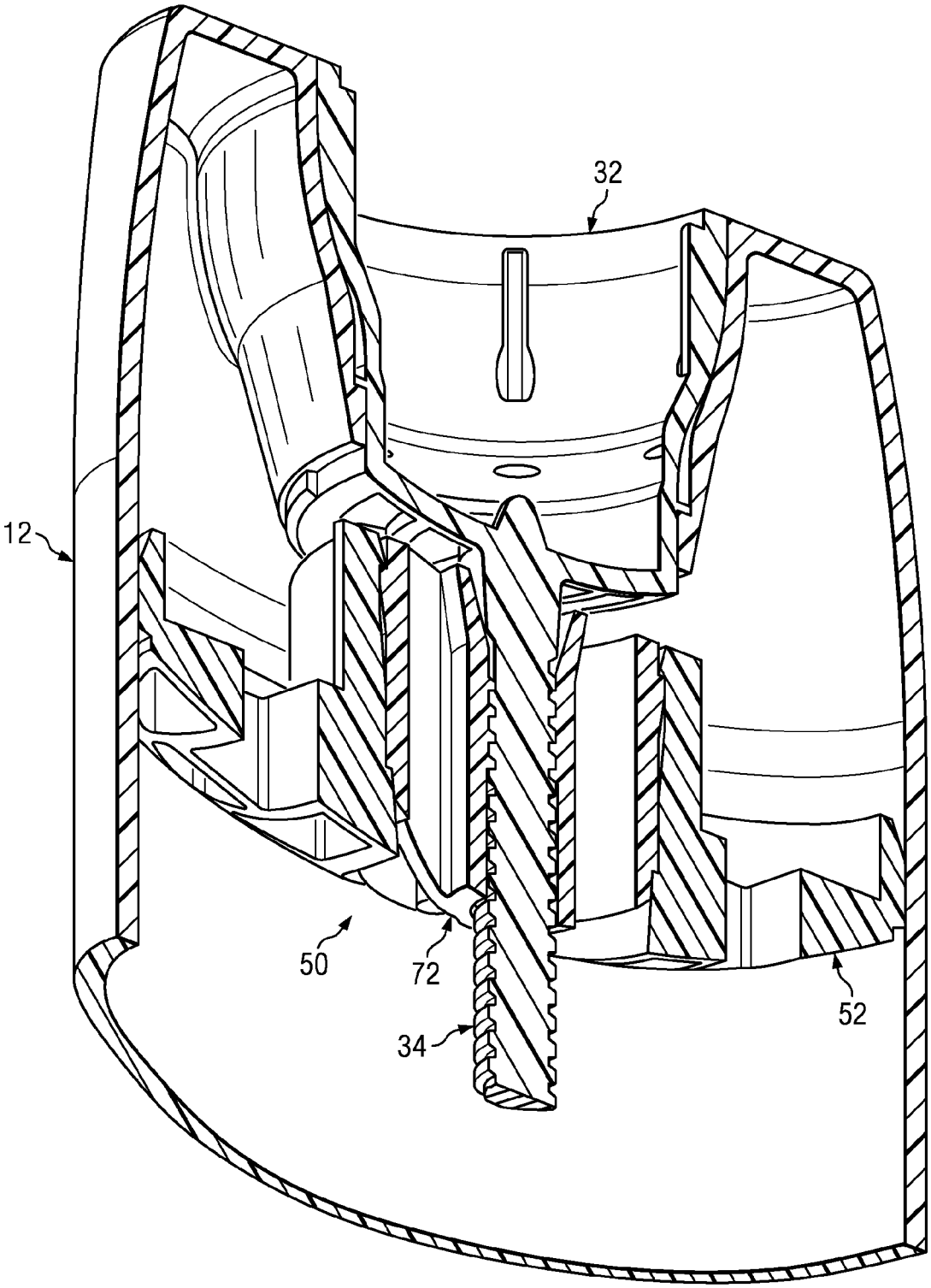
FIG. 6 is a cross-sectional view, shown in perspective, depicting the arrangement of FIG. 4E.

In order to assemble the container, the outer member 52 of the elevator 50 can be inserted through the proximal opening 19 of the body 12, and can be placed in a fill position within the product chamber 26, as generally shown in FIG. 4A. In one embodiment, the body 12 and the outer member 52 can comprise interlocking mechanical features configured to selectively retain the outer member 52 in the fill position. For example, as shown in FIGS. 4A and 5, the body 12 can define a ledge 27, the outer member 52 can define a hook 66, and the hook 66 can engage the ledge 27 to selectively retain the outer member 52 in the fill position.

Then, after the outer member 52 is provided in the fill position within the product chamber 26, any of an open bottom fill process, a closed bottom fill process, or a top fill process can be used to introduce product to the product chamber 26. If an open bottom fill process or a closed bottom fill process is to be used to introduce product to the product chamber 26, the proximal end 18 of the body 12 can be capped. For example, an inner cap 29 can be provided in contact with the body 12, to prevent product from escaping the product chamber 26 through the proximal opening 19 during manufacture, shipment and storage of the container 10. In one embodiment, the inner cap 29 can be molded or otherwise formed from plastic or another material, as generally shown in FIG. 1. When engaged with the body 12, a perimeter 31 of the inner cap 29 can exert a compressive force against the inner surface 22 of the side wall 14, sealing the proximal opening 19 to prevent escape of product from the product chamber 26. The inner cap 29 can also include a flange (not shown) about its perimeter to prevent excessive movement of the inner cap 29 into the product chamber 26, and can additionally include a handle 33 to facilitate grasping and removal of the inner cap 26 by a consumer. Alternatively, a consumer can remove the inner cap 29 by rotating the knob 32, such that the product pushes off the inner cap 29. A surface of the inner cap 29 can be configured to provide a desired shape (e.g., a dome shape) to the end of the product within the product chamber 26 during the fill process. Prior to use of the container 10 to dispense product, a consumer can remove and discard the inner cap 29. The inner cap can alternatively be formed from foil, paper, plastic, wax, or other suitable material(s).

Following installation of the inner cap 29, a cup-shaped closure cap 28 can be removably installed on the proximal end 18 of the body 12, adjacent to the proximal opening 19, such that the cup-shaped closure cap 28 selectively and telescopingly engages an outer surface 24 of the side wall 14 in a slight interference fit. The portion of the side wall 14 adjacent to the proximal end 18 is shown to be thinned or undercut to accommodate the cup-shaped closure cap 28, though it will be appreciated that, in other embodiments, there might not be any thinning or undercutting of the side wall to accommodate a cup-shaped closure-cap. It will also be appreciated that a closure cap can be selectively engaged with a body in any of a variety of other suitable arrangements (e.g., with external threads or snap-closures).

Figure 4B:
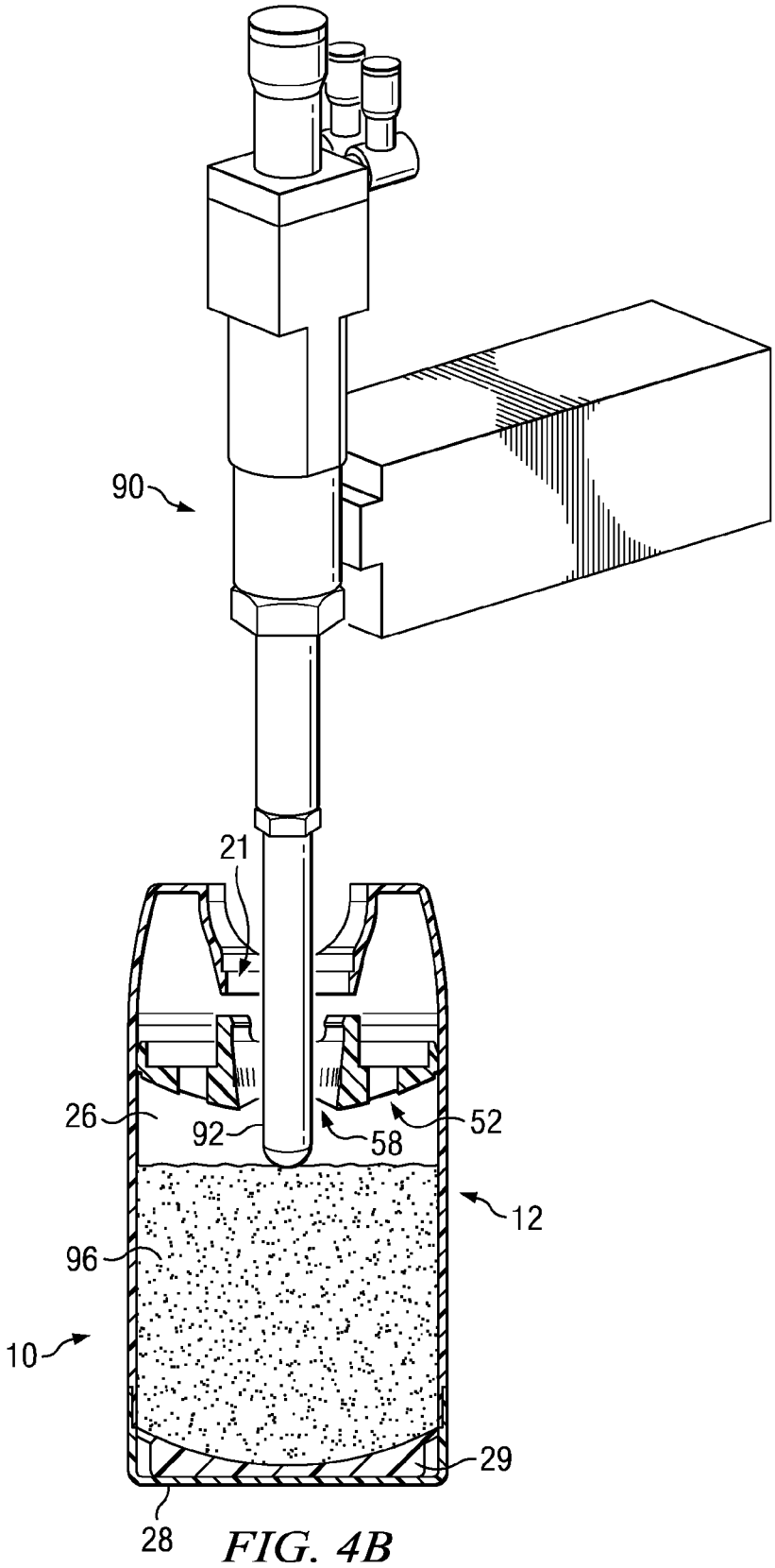
FIG. 4B depicts use of a filler assembly to dispense product into the product chamber of the body of the container of FIG. 1, in an open bottom fill method in accordance with one embodiment, wherein the outer member of the elevator is disposed within the product chamber in the fill position, and an inner cap and a closure cap are each engaged with the body.

If an open bottom fill process or a closed bottom fill process is to be used to introduce product to the product chamber 26, the body 12 can then be inverted so that the distal opening 21 faces upwardly. In an open bottom fill process, a filling head 92 of a filler assembly 90 can then be inserted into the distal opening 21 and into the product chamber 26, as generally shown in FIG. 4B. Product (shown as 96 in FIG. 4B) can then be released from the filling head 92 into the product chamber 26, for example, in a molten or liquid phase. It will be appreciated that, in this configuration, no portion of the container 10 restricts the flow of product from the filling head 92 into the product chamber 26, thereby allowing the delivery of product into the product chamber 26 to occur with less turbulence, and less splashing, than would otherwise occur if the filling head 92 were entirely disposed outside of the product chamber 26 during the fill process, or if the flow of product from the filling head 92 were disrupted (e.g., by a skeletal structure of a drive apparatus and/or elevator) as is typical in a closed bottom fill process.

In one embodiment, the position of the filling head 92 relative to the product chamber 26 can vary proportionally during the fill process, either by moving the filling head 92 or the container 10, or both, in a direction opposite one another, during the fill process, such that the filling head 92 is gradually withdrawn from the product chamber 26. In such an arrangement, as the level of product rises in the product chamber 26, the spacing between the filling head 90 and the surface of the product can remain substantially constant within the product chamber 26, thereby allowing the delivery of product into the product chamber 26 to occur with minimal turbulence and splashing. In one embodiment, during the filling process, it will be appreciated that the container 10 can be rotated relative to the filling head 92, to effect a twist upon the product being filling into the product chamber 26. Once filling is complete, the filling head 92 can be withdrawn from the product chamber 26, if not already withdrawn. This manner of filling can be advantageously used to provide a layered product within the product chamber, such as is described in U.S. Patent Application Publication No. 2009/0324660 to Cetti et al. and published on Dec. 31, 2009.

Figure 4C:
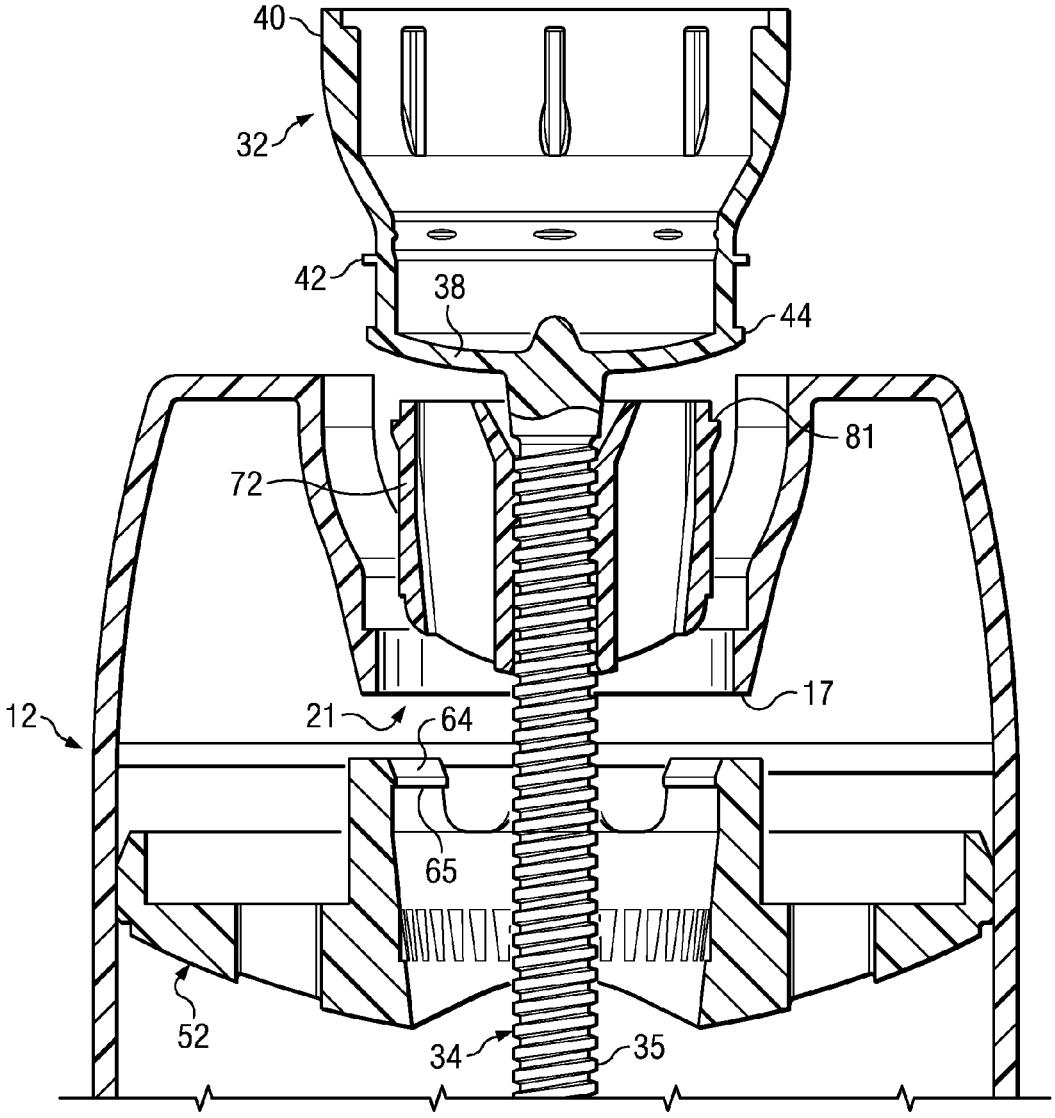
FIGS. 4C-4E are front cross-sectional views depicting the components of FIG. 4A, in association with a drive apparatus and an inner member of the elevator, in progressive stages of assembly.
Figure 4D:
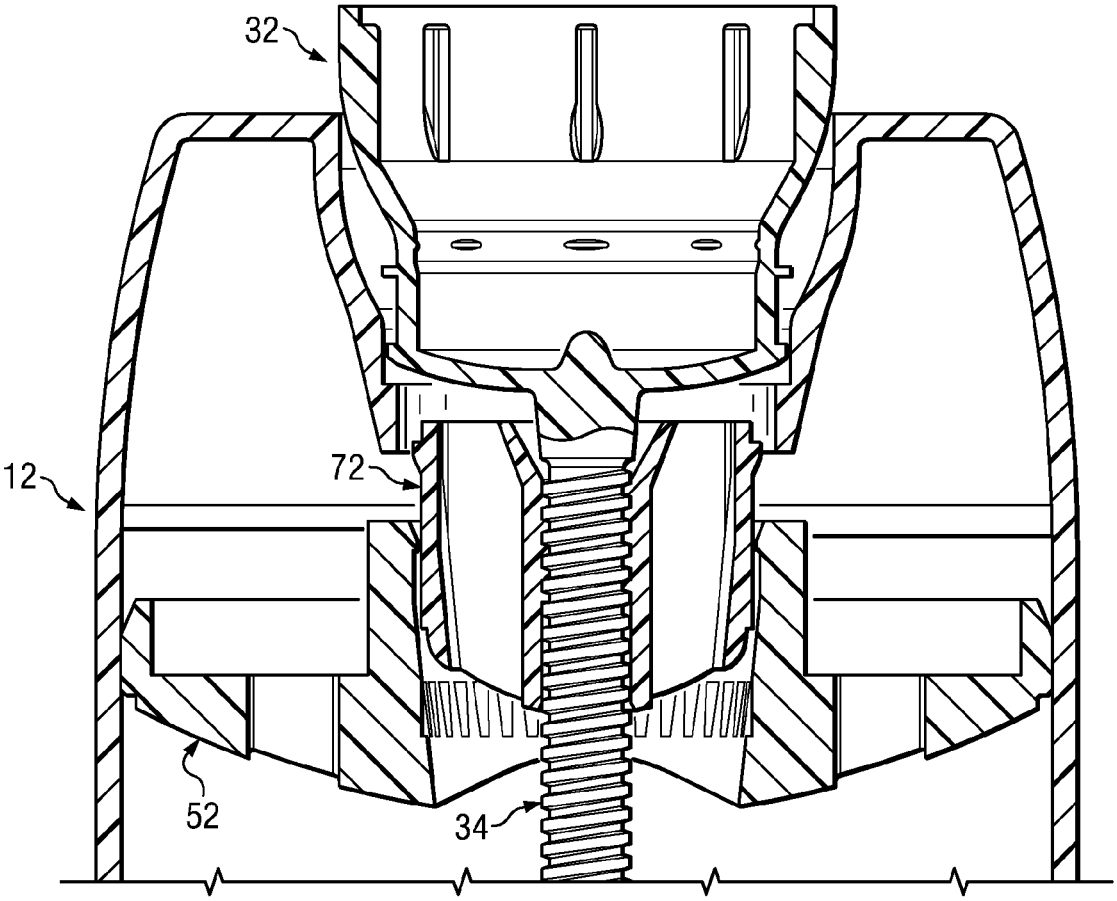
Figure 4E:
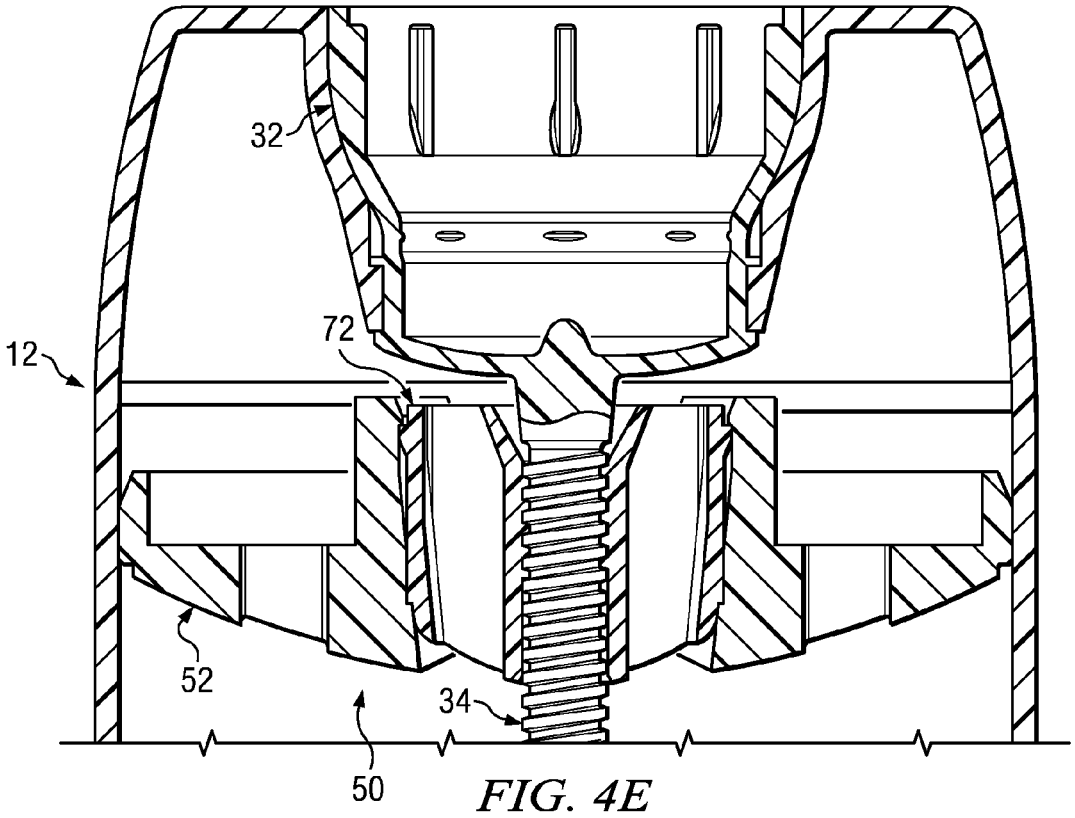

After filling of the product chamber 26 with product in the open bottom fill process, the drive apparatus 30 and the inner member 72 of the elevator 50 can be installed, as shown in FIGS. 4C-4E. The inner member 72 of the elevator 50 can be dimensioned to pass through the distal opening 21 in the base 16 and into mating engagement at least partially within the bore 58 of the outer member 52. In one embodiment, the distal opening 21 can be slightly larger than the lateral dimensions of the inner member 72, as shown in FIGS. 4C-4D for example. In other embodiments, a distal opening can be sized the same as, or slightly smaller than, the lateral dimensions of an inner member of an elevator, such that the inner member might have to be forced through the distal opening.

The elongated stem 34 of the drive apparatus 30 can be inserted into a threaded aperture 78 in the inner member 72 of the elevator 50, such that the inner member 72 of the elevator 50 is threadably engaged with the elongated stem 34. A portion of the drive apparatus 30 can then be inserted through the distal opening 21, such that the inner member 72 of the elevator 50 passes through the distal opening 21 and matingly engages at least partially within the bore 58 in the outer member 52 (as described above), and such that the drive apparatus 30 is rotatably received by the distal opening 21 and axially restrained by the base 16. More particularly, locking tabs 44 of the knob 32 can engage a surface 17 of the base 16 that circumscribes the distal opening 21, to facilitate axial restraint, while allowing rotation, of the drive apparatus 30 relative to the base 16. In this manner, the drive apparatus 30 and the inner member 72 of the elevator 50 can be respectively received by the base 16 and the outer member 52 of the elevator 50, in respective snap-fit configurations. The locking tabs 44 are shown to be spaced from one another, though it will be appreciated that locking tabs can be provided in any of a variety of other suitable configurations, or need not be individual tabs but can be formed as a more continuous structure. The knob 32 can comprise one or more fins (e.g., 42 in FIG. 1) or other features to facilitate sealing of the product within the product chamber 26, and a plug (46 in FIG. 1) can be installed as discussed below, to prevent product from escaping from the distal end 20 of the body 12 during manufacture, shipment, storage and use of the container. In one embodiment, throughout the process of matingly engaging the inner member 72 with the outer member 52, and until such time as the knob 32 is subsequently rotated, the hook 66 can remain engaged with the ledge 27.

It will be appreciated that the present open bottom fill process differs from the conventional method of open bottom filling described in the Background section above, in part because the present open bottom fill process involves the base 16 already being attached to the side wall 14 before beginning to fill product into the product chamber 26, with the distal opening 21 in the base 16 being significantly smaller than a corresponding cross-section of the product chamber 26. The present open bottom fill process thus involves the distal end 20 of the body 12 being less than fully open, or in other words only partially open, during the filling process. In comparison, the conventional method of open bottom filling involves filling of the side wall before the base is even attached to the side wall, and thus has a fully open arrangement during filling.

Figure 7:
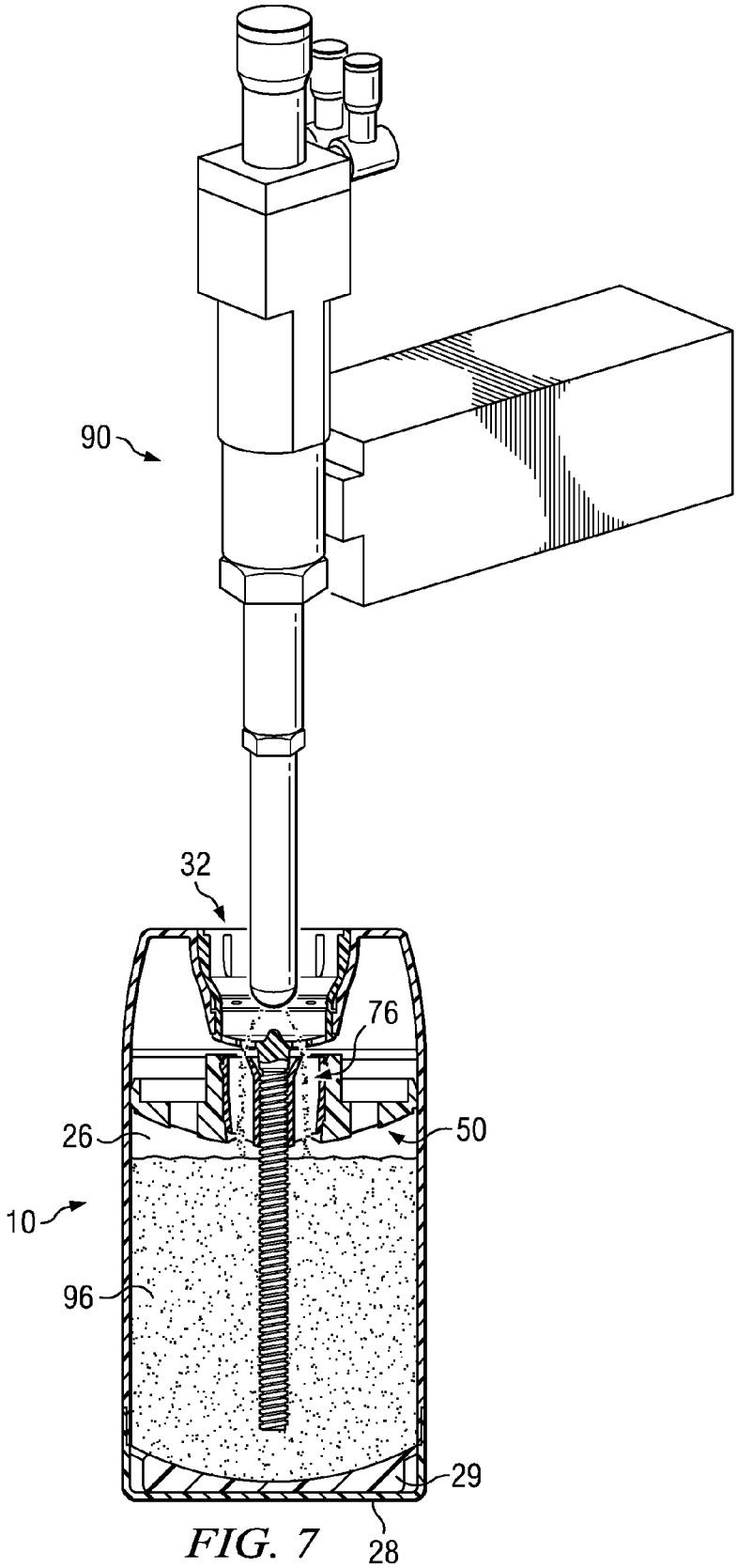
FIG. 7 depicts use of the filler assembly of FIG. 4B to dispense product into the product chamber of the body of the container of FIG. 4E, in a closed bottom fill method in accordance with one embodiment, wherein the outer member of the elevator is disposed within the product chamber in the fill position, and an inner cap and a closure cap are each engaged with the body.

Alternatively, if a closed bottom fill process is to be used to introduce product to the product chamber 26, as shown in FIG. 7, the container 10 can be completely assembled as discussed above (except for installation of plug 46) and, following assembly, can be filled by a filler head 92 dispensing product 96 sequentially through knob apertures 39 in the knob 32, elevator apertures 76 in the inner member 72 of the elevator 50, and into the product chamber 26. After filling of the product chamber 26 in the closed bottom fill process, the plug 46 can be installed.

Through use of the open bottom fill process described above (with the drive apparatus 30 and the inner member 72 absent during filling of the product chamber 26 through the distal opening 21), it will be appreciated that engagement of the drive apparatus 30 with the body 12 can be configured to seal, or substantially seal, the distal end 20 of the body 12 (e.g., with the plug 46 installed). Or, this can be achieved through use of a drive apparatus that does not define any knob aperture (e.g., 39), and without the use of any plug (e.g., 46). In other words, when this open bottom fill process is to be used, a drive apparatus can have a closed knob configuration (e.g., as in FIGS. 8A and 8B), and a plug (e.g., 46) need not be provided, thereby minimizing the number of piece parts. It will be appreciated that, by having a closed knob configuration (e.g., with no knob aperture 39), the knob need not have an open design, and there can accordingly be greater design flexibility in selecting the shape, size, and configuration of the knob (e.g., see FIGS. 8A and 8B). While the knob 32 is shown to have a generally round configuration, it will be appreciated that the knob can have a different shape and configuration, provided that its shape and configuration can facilitate application by the consumer of rotational force relative to the body 12 in order to adjust the axial position of the elevator 50 within the product chamber 26. When the drive apparatus has no knob aperture, the container can be filled either through an open bottom fill process (e.g., prior to installation of the drive apparatus into the distal opening of the container), or through a top fill process (e.g., after installation of the drive apparatus into the distal opening of the container), since it would not be possible to fill the container through a closed bottom fill process (e.g., when the drive apparatus is installed).

Figure 8A:
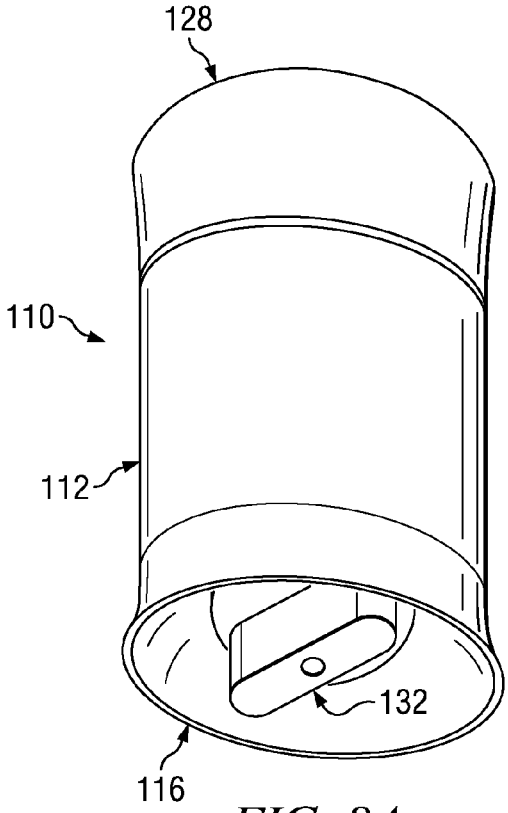
FIG. 8A is a bottom perspective view depicting a container in accordance with another embodiment.
Figure 8B:
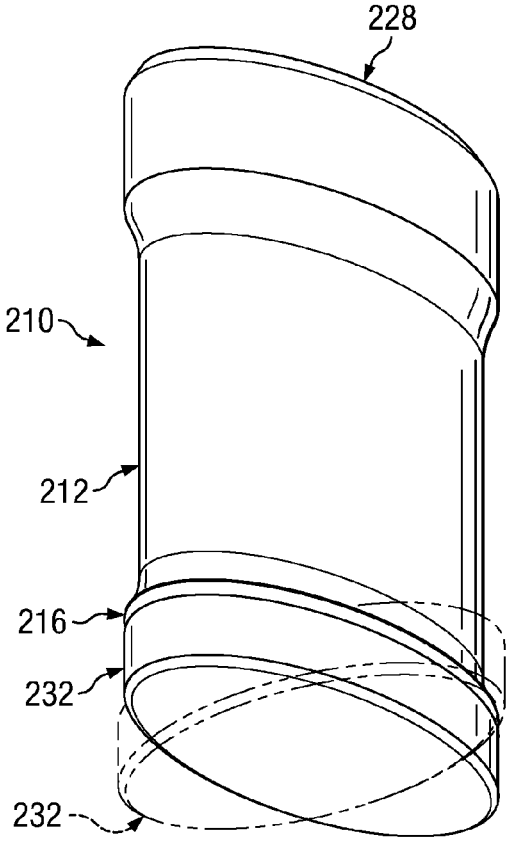
FIG. 8B is a bottom perspective view depicting a container in accordance with yet another embodiment.

FIGS. 8A-8B illustrate examples of knobs that can be possible when a closed bottom fill process is not used, and knob apertures (e.g., 39 in FIG. 1) are not present. More particularly, FIG. 8A illustrates a container 110 having a body 112. A proximal end of the body 112 is shown to be provided with a closure cap 128, and a knob 132 is shown to be provided at a distal end of the body 112, interfacing a base 116 of the body 112. In the configuration of FIG. 8A, it can be seen that the knob 132 has a closed design, and that the base 116 and the knob 132 can be configured relative to one another such that sufficient access is provided to allow a hand of a consumer to grip and rotate the knob 132, without any need for the body 112 to define any knob access openings (e.g., 13 in FIG. 1). As the knob 132 is rotated relative to the body 112, an elevator moves within the product chamber of the body 112.

FIG. 8B illustrates a container 210 having a body 212. A proximal end of the body 212 is shown to be provided with a closure cap 228, and a knob 232 is shown to be provided at a distal end of the body 212, interfacing a base 216 of the body 212. As shown in the embodiment of FIG. 8B, the knob 232 can have a closed design and an outer shape generally corresponding to that of an adjacent portion of the body 212, such that the knob 232 can appear to be part of the body 212 when the knob 232 is aligned with the body 212 (shown in solid lines in FIG. 8B). As the knob 232 is rotated (e.g., shown in dashed lines in FIG. 8B) relative to the body 212, an elevator moves within the product chamber of the body 212. Conventionally, containers having a knob (e.g., like 232) with a closed design and an outer shape generally corresponding to that of an adjacent portion of a body of a container, would have been filled using a top fill process, or through a conventional open bottom fill process in which the product is inserted into a product chamber of the container before attachment of a base to a side wall of the container. In contrast, by having an elevator with inner and outer members as described above, the container 210 can be filled using the present open bottom fill process.

As indicated above, when the drive apparatus 30 defines a knob aperture (e.g., 39), the plug 46 can be installed in contact with the knob 32, to block dispensation of product from the product chamber 26 through the knob aperture (e.g., 39). Though, in some circumstances when the drive apparatus 30 defines a knob aperture, depending upon volatility, fragrance, etc. of the product, and other factors such as shipping and handling conditions and aesthetic requirements, no plug might be provided and the knob aperture can remain open.

It will be appreciated that the container 10, by having the drive apparatus 30 with one or more the knob apertures (e.g., 39), can be used in any of a variety of manufacturing processes, including the open bottom fill process in which the filler head enters the product chamber, the closed bottom fill process in which the product is poured into the product chamber sequentially through a knob aperture and an elevator aperture, and the top fill process. Accordingly, it will be appreciated that the container 10 can provide a standardized configuration for use with multiple distinct manufacturing methods and product lines, and accordingly can eliminate any requirement for a manufacturer to produce different types of containers depending upon the fill process to be employed. In other embodiments, it will be appreciated that one or more components of the container 10 (e.g., the drive apparatus 30, the elevator 50, the closure cap 28, and/or the inner cap 29) can differ depending upon the fill process to be used, while the remaining components of the container 10 can be consistent among fill processes. Conventional fill processes are described in U.S. Pat. Nos. 4,605,330 and 5,401,112.

Once the container 10 is filled with product and fully assembled, the product is allowed to solidify, and the container 10 can then be shipped and/or sold. Rotation of the drive apparatus 30 results in disengagement of the hook 66 from the ledge 27, and axial movement (e.g., up and down movement) of the elevator 50 within the product chamber 26 from the fill position to a use position. In use of the container 10, a consumer can adjust the dispensation of product by rotating the knob 32, which results in axial translation of the elevator 50 within the product chamber 26.

It will be appreciated that the various components of the container 10 can be formed from any of a variety of suitable materials. For example, one or more of the body 12, the closure cap 28, the inner cap 29, the drive apparatus 30, and the elevator 50 can be formed from suitable plastic materials, such as polypropylene or high density polyethylene. The plug 46, if provided, can be formed from a resilient material such as silicone, a foil material, or otherwise. In one embodiment, the body 12 can be formed from a substantially clear or transparent material in order that a consumer can see product within the product chamber 26. In such a configuration, it will be appreciated that a label can be adhered or otherwise applied to an exterior surface of the body 12 for aesthetic purposes, to provide consumer information and/or to conceal various internal features of the container 10. The label can, in one embodiment, be positioned and configured to conceal certain various internal features of the container 10 (e.g., between the distal end 20 and the elevator 50), while defining a window to facilitate viewing by a consumer of product within the product chamber 26. In alternative embodiments, the body 12 can be formed from a substantially opaque material, or can be formed from some combination of substantially transparent and opaque materials.

Various components of the container 10 can be selected depending upon the specific filling process to be used, and/or depending upon the type of product to be filled. For example, in one embodiment, the elevator can differ depending upon whether the container 10 is to be filled with an invisible solid type product or a soft solid type product. For example, the elevator 50 of FIGS. 1-7 can be suitable for use with an invisible solid type product. However, due to the elevator apertures 56, 76 defined by the elevator 50, the elevator 50 is shown to have an open configuration, and might not be suitable for use with a less viscous product, such as a soft solid type product. Accordingly, when the container 10 is to be used with a less viscous product, such as a soft solid type product, the elevator 50 can be replaced with an elevator having a closed configuration, such as one of the elevators 350 and 450 shown in FIGS. 9A and 9B. Certain filling processes, such as for example an open top fill process, can benefit through use of an elevator having a closed configuration (e.g., as in FIGS. 9A and 9B) versus an elevator having an open configuration (e.g., as in FIGS. 1-7).

Figure 9A:
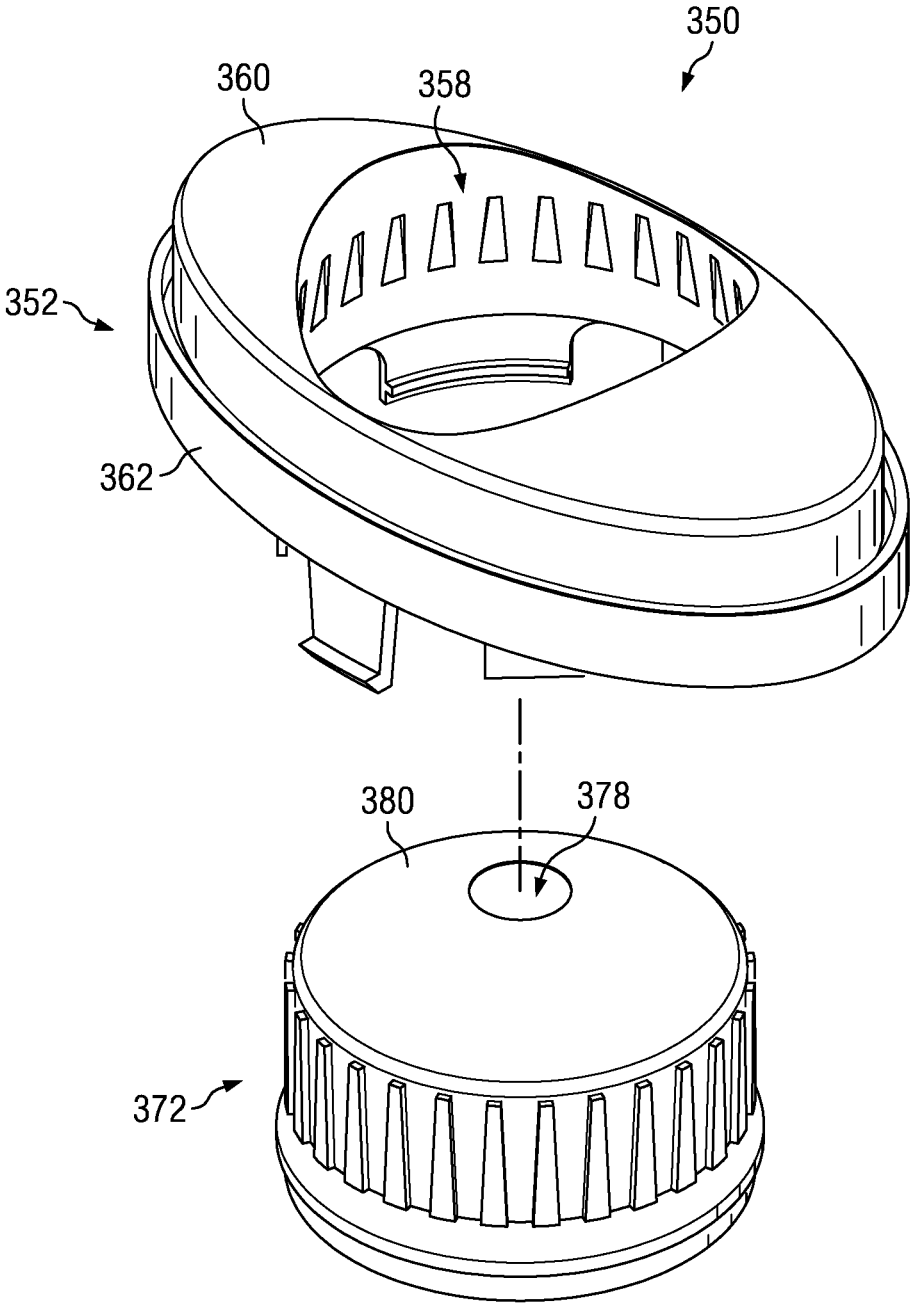
FIG. 9A is an exploded perspective view depicting an elevator in accordance with another embodiment.

With particular reference to FIG. 9A, it can be seen that the elevator 350 can be similar to the elevator 50 of FIGS. 1-7, except with respect to two features. First, unlike the elevator 50, an exterior rim structure 362 of an outer member 352 of the elevator 350 is shown to be smooth (e.g., does not include skis 70), for closely engaging the inner surface 22 of the side wall 14 during sliding of the elevator 350 within the product chamber 26. The exterior rim structure 362 can accordingly have a sealed engagement with the inner surface 22 of the side wall 14 of the body 12, so as to prevent or substantially prevent a less viscous product (e.g., a soft solid type product) from passing between the inner surface 22 and the outer member 352, and/or to prevent or substantially prevent the leaving of product residue on the inner surface 22 of the side wall 14 following movement of the elevator 350. A portion of the exterior rim structure 362 can comprise a wiper (not shown), either formed integrally with the remainder of the outer member 352, or formed separately from and attached to the outer member 352.

Second, unlike the elevator 50, the elevator 350 is shown not to include any skeletal structure that defines apertures for receiving product (e.g., like elevator apertures 56 and 76 in FIG. 1). The outer member 352 of the elevator 350 defines a bore 358, but like the elevator 50, the bore 358 can matingly receive an inner member 372 of the elevator 350, in a sealed or substantially sealed configuration. Additionally, the inner member 372 of the elevator 350 defines a threaded aperture 378, but like the elevator 50, the threaded aperture 378 can matingly receive the elongated stem 34 of the drive apparatus 30, in a sealed or substantially sealed configuration. Accordingly, upper surfaces 360 and 380 of an outer member 352 and an inner member 372, respectively, of the elevator 350, can be closed to prevent or substantially prevent flow of product from the product chamber 26 through the elevator 350 during use of the container by a consumer.

Figure 9B:
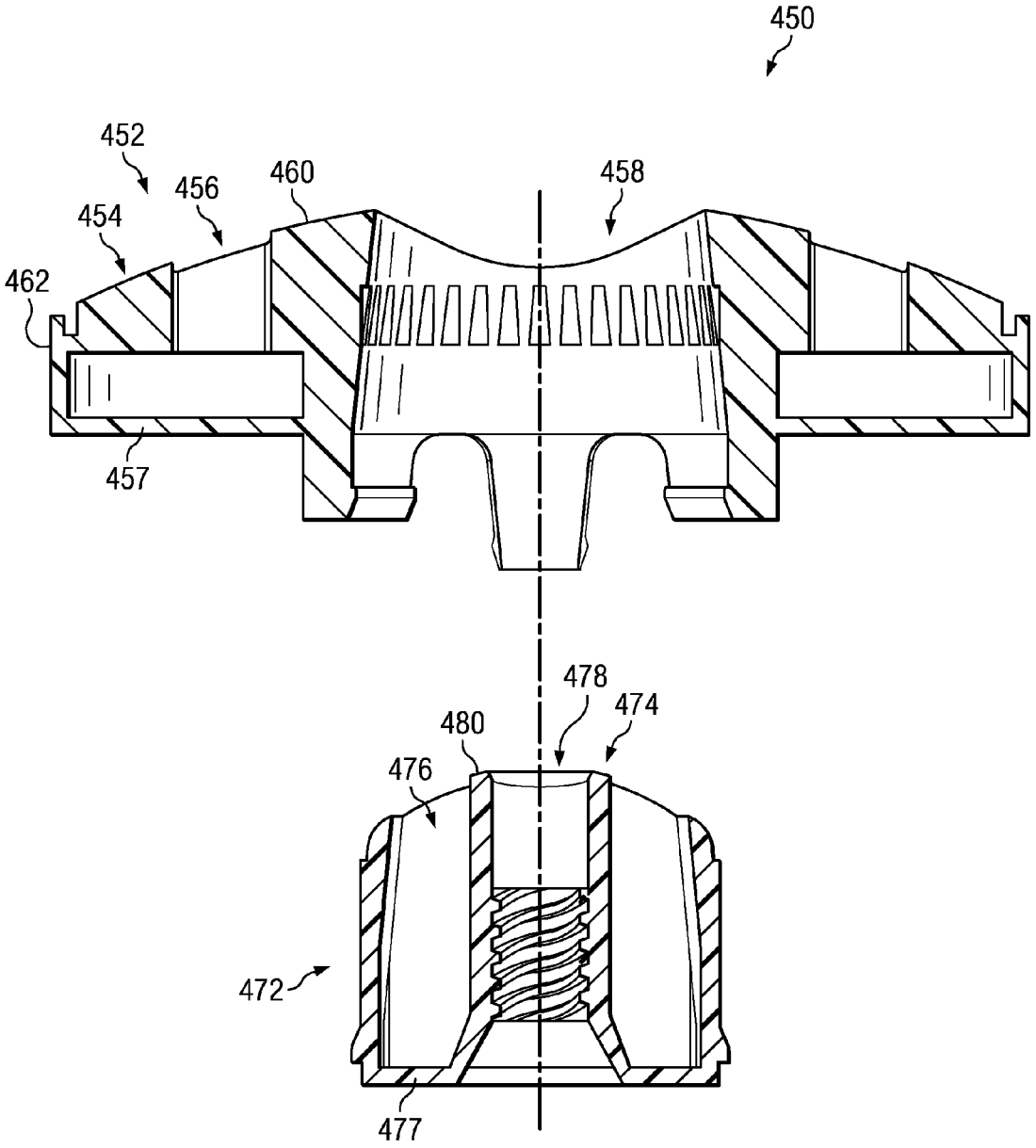
FIG. 9B is a cross-sectional view depicting an elevator in accordance with yet another embodiment.
Figure 9C:
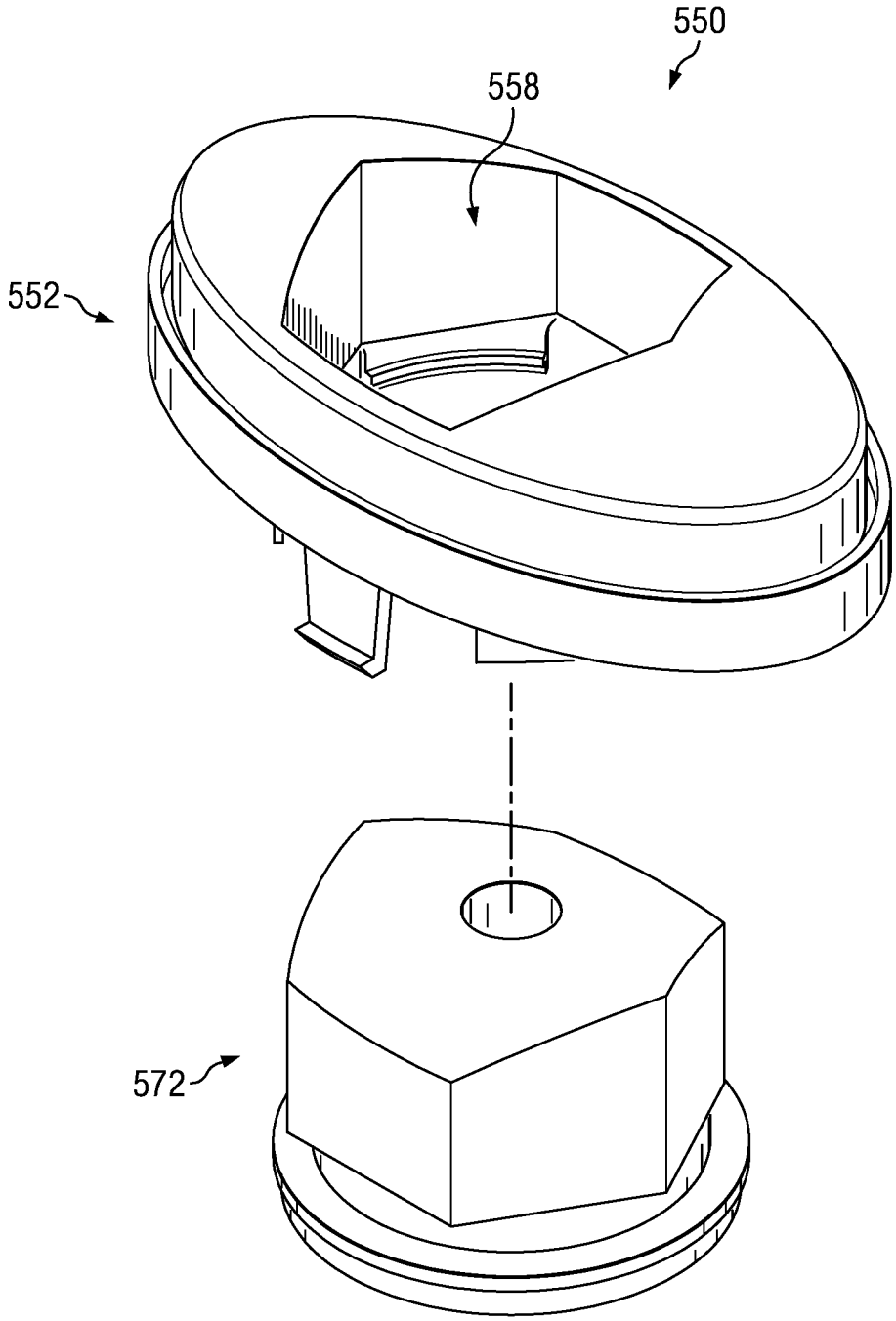
FIG. 9C is an exploded perspective view depicting an elevator in accordance with still another embodiment.
Figure 9D:
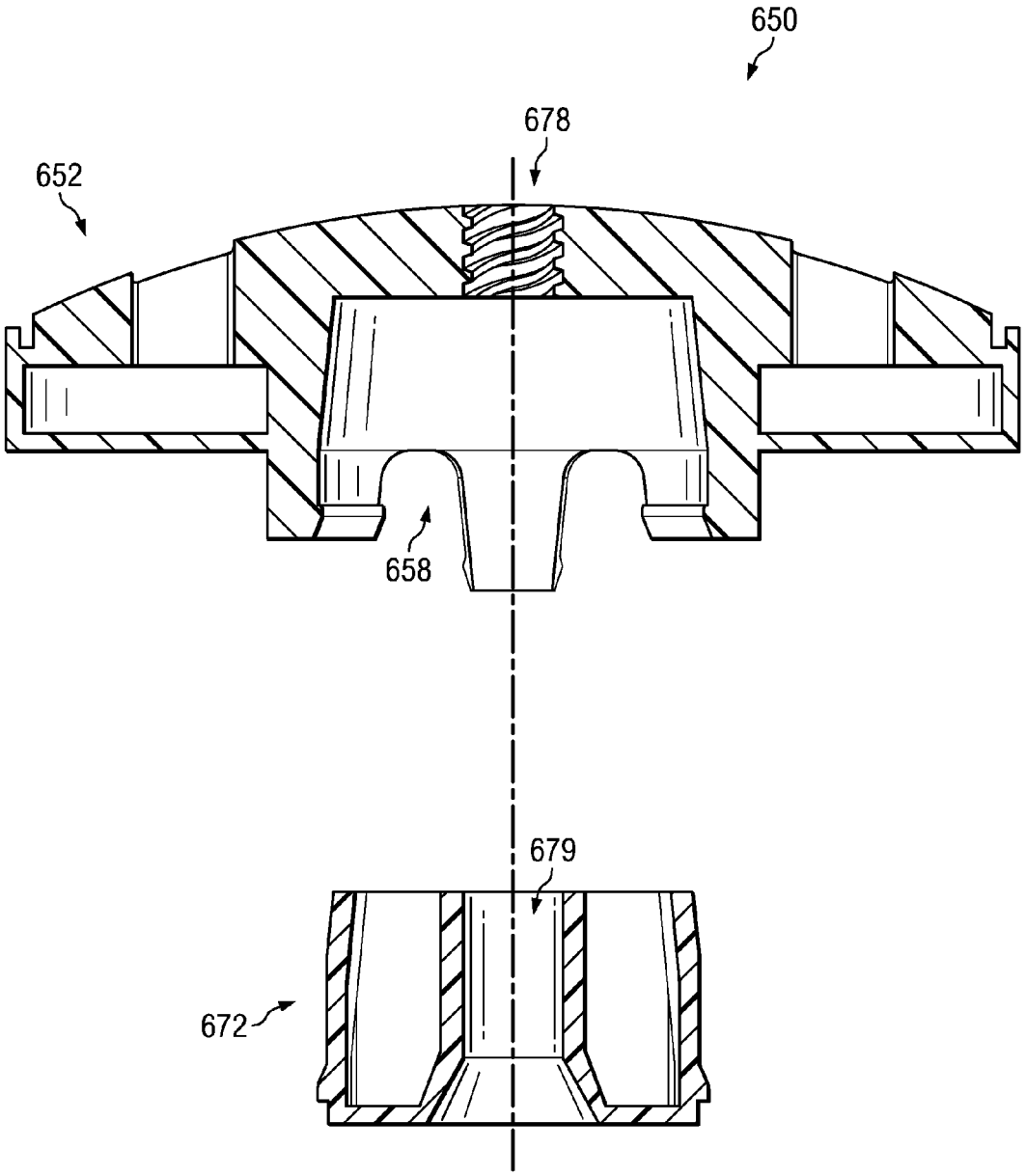
FIG. 9D is a cross-sectional view depicting an elevator in accordance with still another embodiment.

FIG. 9B illustrates an elevator 450 having a hybrid design, blending features of elevator 50 and elevator 350. More particularly, the elevator 450 comprises an outer member 452 and an inner member 472 that comprise respective skeletal structures 454 and 474. As with the elevators 50 and 350, the outer member 452 of the elevator 450 defines a bore 458 that can matingly receive the inner member 472 of the elevator 450, in a sealed or substantially sealed configuration. Additionally, like the elevators 50 and 350, the inner member 472 of the elevator 450 defines a threaded aperture 478 that can matingly receive the elongated stem 34 of the drive apparatus 30, in a sealed or substantially sealed configuration. Like the elevator 350, an exterior rim structure 462 of an outer member 452 of the elevator 450 is shown to be smooth (e.g., does not include skis 70), for closely engaging the inner surface 22 of the side wall 14 during sliding of the elevator 450 within the product chamber 26, so as to prevent or substantially prevent product from passing between the inner surface 22 and the outer member 452. The skeletal structures 454 and 474 are shown to define respective openings 456 and 476, but unlike the elevator apertures 54 and 74 of the elevator 50, the openings 456 and 476 are shown to be closed by respective walls 457 and 477. Therefore, upper surfaces 460 and 480 of the respective outer and inner members 452 and 472 are shown to be open (e.g., to facilitate gripping of the elevator 50 to product, such as an invisible solid type product), while the outer and inner members 452 and 472 are configured to prevent flow of product through the elevator 450, in part accomplished by walls 457 and 477, making the elevator 50 suitable for use with soft solid type products. Accordingly, the elevator 450 can accordingly be used with both invisible solid type products and soft solid type products, and in both bottom and top fill processes. It will be appreciated that an elevator can be provided in any of a variety of other suitable open or closed configurations.

It will also be appreciated that a multi-piece elevator as described above (e.g., elevator 50, 350, 450, or 550) can be used to replace an elevator of an otherwise conventional container (not shown). In such use, the inner and outer members of the elevator can be assembled together, prior to insertion of the assembled elevator into the product chamber of the container. The container can then be filled with product using any of the conventional fill processes.

An elevator can be provided in any of a variety of alternative embodiments. For example, with reference to FIG. 9D, an elevator 650 can comprise an outer member 652 that can be similar in some ways to the outer member 452 of FIG. 9B, except that the outer member 652 is shown to define both a hole 658 and a threaded aperture 678. The hole 658 and the threaded aperture 678 are shown to be coaxial with one another and to cooperate in defining a passage extending axially through the outer member 652. The hole 658 and the threaded aperture 678 can be sized and configured such that, during a bottom fill process, a filling head (not shown) can be received into the hole 658, and product can be dispensed from the filling head and through the threaded aperture 678 into a product chamber of a container (not shown). In this configuration, it will be appreciated that the presence of the hole 658 can allow an orifice (not shown) in the filling head to be aligned with and adjacent to the threaded aperture 678, to prevent any significant amount of the dispensed product from filling the hole 658, or perhaps contacting any part of the outer member 652, during this dispensation process. In one embodiment, the hole 658 can have a cross-sectional area greater than 3 $cm^2$. After dispensation of product into the product chamber, the filling head can be removed from the hole 658, an inner member 672 can optionally be inserted into the hole 658 in a snap-fit configuration, and an elongated stem of a drive apparatus can be passed through a passage 679 in the inner member 672 and into threaded engagement with the threaded aperture 678 of the outer member 652.

Figure 9E:
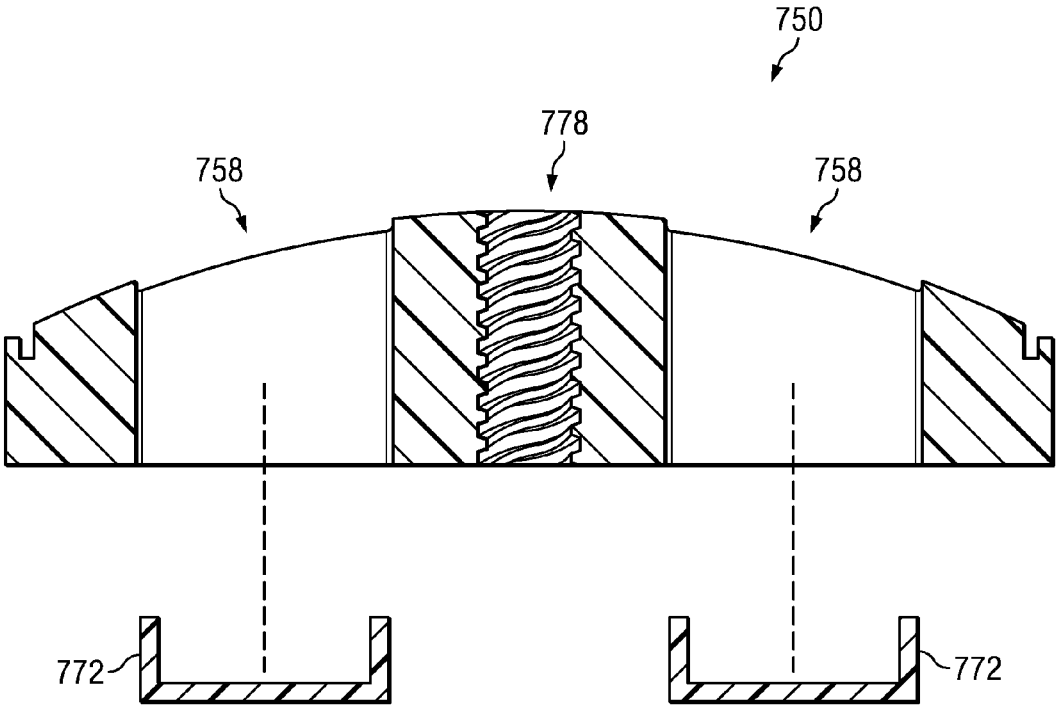
FIG. 9E is a cross-sectional view depicting an elevator in accordance with yet another embodiment.

In yet another embodiment, with reference to FIG. 9E, an elevator 750 is shown to define a threaded aperture 778 and two holes 758. The threaded aperture 778 and the holes 758 are shown to be spaced from one another and to pass axially through the elevator 750 in parallel. In this configuration, the elevator 750 need not comprise an inner and outer member as previously described with respect to other embodiments. The threaded aperture 778 can be located near or at the center of the elevator 750, and can be configured for receiving a threaded stem (not shown) of a drive apparatus. Each of the holes 758 can be sized to receive a respective filling head, so that during an open bottom fill process or a closed bottom fill process, the filling head(s) can be inserted through one or both of the holes 758 and into a product chamber of a container (not shown). If a closed bottom fill process is to be used, it will be appreciated that the base of a container can be provided with one or more corresponding apertures or otherwise configured to allow the filling head to pass into one or both of the holes 758.

The elevator 750 can be provided as a unitary structure, or optionally as a multi-piece unit. For example, after dispensation of product into the product chamber, the filling head(s) can be removed from the hole(s) 758, one or more inner member(s) 772 can optionally be provided to plug the hole(s) 758 (e.g., in a snap-fit configuration), and the threaded stem of the drive apparatus can be provided in threaded engagement with the threaded aperture 778. In some embodiments, each hole 758 can have a cross-sectional area greater than 3 cm2, 4 cm2, 5 cm2 and/or less than 8 cm2, 7 cm2, or 6 cm2 in order to accommodate the filling head passing there through into the product chamber. While the elevator 750 is shown to comprise two holes 758 on opposite sides of the threaded aperture 758, it will be appreciated that an elevator can alternatively comprise two holes provided in a different configuration, only one hole (provided on one side of the threaded aperture 758), or more than two holes, with each such hole being large enough to receive a filling head. In this configuration, it will be appreciated that each of the inner member(s) 772 need not be threaded, as previously discussed, since they do not engage a threaded stem of a drive assembly.

It will therefore be appreciated that the container can be filled using any of a closed bottom fill process, an open bottom fill process, and a top fill process. Due to its modular configuration, certain components of the container can be replaced to optimize manufacturing, consumer use, and/or cost, depending for example upon the type of filling process to be employed and the type of product to be filled. Accordingly, the same container, or the same container but with certain components replaced (e.g., a closed elevator versus an open elevator), can be used with any of a variety of types of conventional filling machinery, thereby allowing a manufacturer to consolidate inventory to a single type of container despite filling with multiple types of products and with different types of filling machinery. Therefore, through use of the container as described above, the same manufacturing line, or a similar manufacturing line, can be employed to fill different types of products, e.g., soft solid type products and invisible solid type products. Accordingly, significant manufacturing efficiencies, standardization and reduction of inventory can be achieved.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited, including U.S. Patent Application No. 61/583,012 filed on Jan. 4, 2012. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container configured for selectively dispensing a personal care product, the container comprising:

a body comprising a side wall and a base, the side wall comprising an inner surface that at least partially defines a product chamber, the inner surface extending axially from the base to a proximal opening, the base defining a distal opening;

a drive apparatus comprising a knob, an elongated stem and a skeletal structure coupling the knob and the elongated stem, the elongated stem defining a thread and the skeletal structure comprising an upper surface and defining one or more apertures extending axially through the skeletal to permit axial flow of molten product through the drive apparatus during filling; and an elevator disposed within the product chamber and comprising an inner member and an outer member, the inner member defining a threaded aperture, the outer member defining a bore and comprising an exterior rim structure in engagement with the inner surface of the side wall of the body, the inner member dimensioned to pass through the distal opening in the base and into mating engagement at least partially within the bore of the outer member and the inner member comprising a skeletal structure comprising an upper surface and defining one or more apertures extending axially through the inner member to permit axial flow of molten product through the inner member during filling;

wherein rotation of the drive apparatus results in axial movement of the elevator within the product chamber.

2. The container of claim 1, wherein the base is formed as a unitary structure with the side wall and wherein the knob is formed as a unitary structure with the elongated stem.

3. The container of claim 1, further comprising a product disposed within the product chamber that comprises at least one antiperspirant active.

4. The container of claim 1, further comprising:

a cup-shaped closure cap, wherein the side wall further comprises an outer surface, and the cup-shaped closure cap selectively engages the outer surface in an interference fit adjacent to the proximal opening; and an inner cap in contact with the body, the inner cap configured to block dispensation of product from the product chamber through the proximal opening.

5. The container of claim 1, wherein the elevator comprises a dome-shaped upper surface and wherein the dome-shaped upper surface of the elevator comprises surface discontinuity to facilitate adherence to the elevator by a product disposed in the product chamber.

6. The container of claim 1, further comprising a plug in contact with the knob, the plug configured to block dispensation of product from the product chamber through the knob aperture.

7. The container of claim 1, wherein the inner member and the outer member comprise corresponding anti-rotation structures configured to facilitate radial retention of the inner member relative to the outer member, the corresponding anti-rotation structures comprising:

a plurality of protrusions defined by one of the inner member and the outer member; and a plurality of grooves defined by the other of the inner member and the outer member; and wherein respective ones of the protrusions engage respective ones of the grooves at respective locations circumferentially disposed about the bore.

8. The container of claim 1, wherein the inner member and the outer member comprise corresponding anti-rotation structures configured to facilitate radial retention of the inner member relative to the outer member, the corresponding anti-rotation structures comprising the inner member and the bore of the outer member having complementary non-circular shapes when viewed in a top plan view.

9. The container of claim 1, wherein the outer member defines a ridge inwardly circumscribing at least a portion of the bore, wherein the ridge facilitates axial retention of the inner member relative to the outer member.

10. A container configured for selectively dispensing a personal care product, the container comprising:

a body comprising an inner surface, the inner surface at least partially defining a product chamber and defining a proximal opening;

a drive apparatus comprising a knob, an elongated stem and a skeletal structure coupling the knob and the elongated stem, the elongated stem defining a thread and the skeletal structure comprising an upper surface and defining one or more apertures extending axially through the skeletal structure to permit axial flow of molten product through the drive apparatus during filling; and an elevator disposed within the product chamber and comprising an inner member and an outer member, the inner member defining a threaded aperture, the outer member defining a bore and comprising an exterior rim structure in engagement with the inner surface of the body, the inner member engaged in a snap-fit at least partially within the bore of the outer member and the inner member comprising a skeletal structure comprising an upper surface and defining one or more apertures extending axially through the inner member to permit axial flow of molten product through the inner member during filling;

wherein rotation of the drive apparatus results in axial movement of the elevator within the product chamber; and a product disposed within the product chamber comprising at least one antiperspirant active.

11. The container of claim 10, wherein the elevator comprises a dome-shaped upper surface and wherein the dome-shaped upper surface of the elevator comprises surface discontinuity to facilitate adherence to the elevator by a product disposed in the product chamber.

12. The container of claim 11, wherein the inner member and the outer member comprise corresponding anti-rotation structures configured to facilitate radial retention of the inner member relative to the outer member, wherein the corresponding anti-rotation structures comprise:

a plurality of protrusions defined by one of the inner member and the outer member; and a plurality of grooves defined by the other of the inner member and the outer member; and wherein respective ones of the protrusions engage respective ones of the grooves at respective locations circumferentially disposed about the bore.

13. The container of claim 11, wherein the inner member and the outer member comprise corresponding anti-rotation structures configured to facilitate radial retention of the inner member relative to the outer member, wherein the corresponding anti-rotation structures comprise the inner member and the bore of the outer member having complementary non-circular shapes when viewed in a top plan view.

14. The container of claim 10, wherein the outer member defines a ridge inwardly circumscribing at least a portion of the bore, wherein the ridge facilitates axial retention of the inner member relative to the outer member.

15. The container of claim 10 wherein the outer member comprises a skeletal structure comprising an upper surface and defining one or more apertures extending axially through the member to permit axial flow of molten product through the outer member during filling.

16. The container of claim 1 wherein the outer member comprises a skeletal structure comprising an upper surface and defining one or more apertures extending axially through the member to permit axial flow of molten product through the outer member during filling.

* * * * *